US010682742B2

(12) United States Patent
Gudjonsson

(10) Patent No.: US 10,682,742 B2
(45) Date of Patent: Jun. 16, 2020

(54) MULTIPURPOSE WOODWORKER'S CLAMPING AND SPREADING APPARATUS

(71) Applicant: Sigurdur Gudjonsson, Middlebury, VT (US)

(72) Inventor: Sigurdur Gudjonsson, Middlebury, VT (US)

( * ) Notice: Subject to any disclaimer, the term of this patent is extended or adjusted under 35 U.S.C. 154(b) by 305 days.

(21) Appl. No.: 15/932,654

(22) Filed: Apr. 3, 2018

(65) Prior Publication Data

US 2019/0299368 A1 Oct. 3, 2019

(51) Int. Cl.

| | |
|---|---|
| ***B25B 5/00*** | (2006.01) |
| ***B25B 5/10*** | (2006.01) |
| ***B25B 5/16*** | (2006.01) |
| ***B25B 5/14*** | (2006.01) |

(52) U.S. Cl.

CPC ..... *B25B 5/102* (2013.01); *B25B 5/003* (2013.01); *B25B 5/14* (2013.01); *B25B 5/163* (2013.01); *B25B 5/166* (2013.01)

(58) Field of Classification Search

USPC ..... 269/246, 101, 178, 282, 37, 85

See application file for complete search history.

(56) References Cited

U.S. PATENT DOCUMENTS

| | | | |
|---|---|---|---|
| 669,282 | A | 3/1901 | Lanpher |
| 710,544 | A | 10/1902 | Wandell |
| 1,811,518 | A | 6/1931 | Palmer |
| 2,137,315 | A | 11/1938 | Ulrich |
| 2,973,792 | A | 3/1961 | Fonken |
| 3,596,898 | A | 8/1971 | Hilburn |
| 4,234,176 | A | 11/1980 | Goff et al. |
| D259,327 | S | 5/1981 | Sloane |
| 4,552,345 | A | 11/1985 | Benda et al. |

(Continued)

FOREIGN PATENT DOCUMENTS

| | | | |
|---|---|---|---|
| DE | 19941921 | C1 | 3/2001 |
| WO | WO2017/004655 | A1 | 1/2017 |

(Continued)

OTHER PUBLICATIONS

Rockler® Woodworking and Hardware Bessey® K Body® Revo Jr. Parallel Clamps.

*Primary Examiner* — Joseph J Hail
*Assistant Examiner* — Shantese L McDonald
(74) *Attorney, Agent, or Firm* — John J. Welch, Jr., Esq.

(57) ABSTRACT

A multipurpose woodworker's clamping and spreading apparatus consisting of an elongated support bar component and a pair of elongated crossbar components held together by the respective vertically inclined and horizontally inclined sleeving elements of each of a pair of a two-way adjustable bar holder components with each crossbar holding, as well, one of each of a pair of adjustable workholder components via the horizontally inclined sleeving member of each and with each workholder component featuring an externally threaded holding bolt threadably held within the bolt holder thereof welded to the sleeving member and with the ball shaped end portion of a small rod extension from the base of the bolt, rotatably holding a shoeholder element, in turn holding a shoe element, the sleeving member portion of which features sleeving for such holding and the base member portion of which serves to hold work for clamping or spreading.

24 Claims, 30 Drawing Sheets

(56) References Cited

U.S. PATENT DOCUMENTS

| | | | | |
|---|---|---|---|---|
| 5,024,428 | A | 6/1991 | Ramsay | |
| 5,427,364 | A | 6/1995 | Zborschil | |
| 5,730,434 | A * | 3/1998 | Schoene | B23D 47/04 269/249 |
| 6,067,693 | A | 5/2000 | Chen | |
| 6,431,534 | B1 | 8/2002 | Orosz et al. | |
| 6,746,006 | B2 | 6/2004 | Thomas | |
| D500,238 | S | 12/2004 | Varzino | |
| 6,848,683 | B2 | 2/2005 | Foshag et al. | |
| 6,913,234 | B2 | 7/2005 | Weiss | |
| 6,955,344 | B2 | 10/2005 | Brass et al. | |
| 8,313,095 | B2 | 11/2012 | Kloepfer et al. | |
| 8,322,697 | B2 | 12/2012 | Lin | |
| 8,702,077 | B2 | 4/2014 | Liu | |
| 9,022,375 | B2 | 5/2015 | Allred, III et al. | |
| 9,193,040 | B2 * | 11/2015 | Schmidt | B25B 1/2473 |
| 9,308,626 | B2 | 4/2016 | Chuang | |
| 9,757,843 | B2 | 9/2017 | Edge | |
| 2010/0164158 | A1 * | 7/2010 | Weissenborn | A63C 11/26 269/101 |
| 2014/0124999 | A1 | 5/2014 | Foss | |
| 2015/0343607 | A1 | 12/2015 | Wang | |
| 2016/0001425 | A1 | 1/2016 | Kregloski | |
| 2017/0043453 | A1 | 2/2017 | Chen | |

FOREIGN PATENT DOCUMENTS

| | | | |
|---|---|---|---|
| WO | WO2017/088030 | A1 | 6/2017 |
| WO | WO2017/163218 | A1 | 9/2017 |

* cited by examiner

MULTIPURPOSE WOODWORKER'S CLAMPING AND SPREADING APPARATUS

FEDERALLY SPONSORED RESEARCH AND DEVELOPMENT

The invention is not the subject of any federally sponsored research and development.

PRIOR OR PARENT APPLICATIONS

The invention is not the subject of any prior or parent applications.

FIELD OF THE INVENTION

The invention is one within that coterie of inventions serving to clamp together or alternatively separate from one another, various pieces of wood.

PRIOR ART

The various references set forth within the Information Disclosure Statement herewith submitted somewhat perhaps resemble the invention but do not anticipate the invention.

SUMMARY OF THE INVENTION

A Brief Description of the Invention

The invention features a vertically inclined elongated metallic support bar component as well as each of a pair of horizontally inclined elongated metallic crossbar components. Each crossbar component is held fast to the support bar component by one each of a pair of two-way adjustable bar holder components. Each bar holder component features a horizontally inclined sleeving element welded to an anchoring plate also affixed by a weld to a vertically inclined sleeving element. Such sleeving facilitates adjustments in respect of each crossbar at various distances away from one another vertically, up and down, along the support bar component as well as to facilitate horizontal elongation of each crossbar component in ultimately fixed positions. Such adjustments are accomplished with resort to externally threaded horizontally inclined bolts affixed to each of which there is a turning handle element serving to facilitate advancement of each bolt through holes within each of such sleeving elements. The invention also features a pair of adjustable work-holder components. Each workholder component is featured by the presence of a vertically inclined handle element within which there is a closed hole amenable to receipt of the head of a vertically inclined elongated holding bolt. Each workholder component also features a horizontally inclined sleeving member amenable to adjustable receipt of a crossbar component. Each workholder component also features an internally threaded bolt holder element welded to the sleeving member for receipt of the threading about the body portion portion of each such vertically inclined holding bolt being a short, solid metallic rod, the lower end portion of which is in the shape of a solid, metallic ball. Seated loosely about each ball shaped end portion is one of a pair of typically rectangularly shaped, metallic shoeholder elements, typically solid throughout. Such loose but nevertheless permanent seating is made possible by virtue of the presence of an ultimately crimped superior hole centrally found within the upper portion of each of a pair of metallic housing units, each soldered at its lower brim to and atop one of the shoeholder elements, which holes are each amenable before crimping to receipt of a ball shaped end portion of an extension member metallic rod. Each shoeholder element has depth and a flat bottomside. The ultimate crosswise breadth of each so crimped hole is less than the diameter of the ball shaped end portion of the metallic rod. This sidewise breadth and diametric difference allows for each shoeholder element to be loosely and rotatably but permanently held about the ball shaped end portion of each rod. Each shoeholder element serves to hold any one of a number of shoe elements of the invention. Each shoe element features one portion being a rectangularly shaped sleeving member readily amenable to receipt of the lateral sides of each shoeholder element. Each shoe element also features a base member portion for holding work to be clamped or spread. The shoe elements are used two at a time, one per shoeholder element for clamping or spreading purposes. The surfaces of the base member portions have shapes respectively ranging from flat to being variously contoured.

Objects of the Invention

Currently, woodworkers have devices that serve to clamp together pieces of wood and other devices for spreading apart pieces of wood amenable to being held together in but function to either clamp or spread pieces of wood and, within the aegis of either a horizontally inclined plane or alternatively within the aegis of a vertical inclined plane. Also, current clamping devices are constructed in such a manner that they are limited in terms of the sizes of the pieces of wood sought to be clamped. This is to say that the so-called "throats" of such devices are limited and fixed in size as determined by the lengths of the fixed crossbar portions of each of such devices and, also, by virtue of the crossbars being affixed at a fixed distance from one another, each to the support bar portion of each of such devices, thereby limiting the sizes of the pieces of wood amenable to clamping. The present invention, on the other hand, features an ever-expandable "throat" whereas each crossbar portion of the present invention can readily be lengthened simply by pushing each through and then tightening each to and within the horizontally inclined sleeving portion of each two-way adjustable bar holder components of the invention and, whereas, moreover, each crossbar can be variably affixed to different locations along any elongated support bar, such that the distance between ultimately affixed crossbars can be readily varied, simply by way of pushing each so tightened and held crossbar up or down the support bar via the vertically inclined sleeving portion of each adjustable bar holder component and then simply tightening the holder to the support bar. Moreover, current clamping devices are relatively limited by virtue of their construction in terms of how tightly and firmly pieces of wood of various surface shapes can be held to one another during clamping. The shoeholder elements in combination with the shoe elements of the invention serve to virtually always assure that such pieces of wood, regardless of surface shape will be optimally, tightly and firmly held during clamping or spreading.

The foregoing features of the new and unique present invention serve to render it accordingly very useful as well.

A DESCRIPTION OF THE DRAWINGS

A DESCRIPTION OF THE PREFERRED EMBODIMENTS

Figure 1:
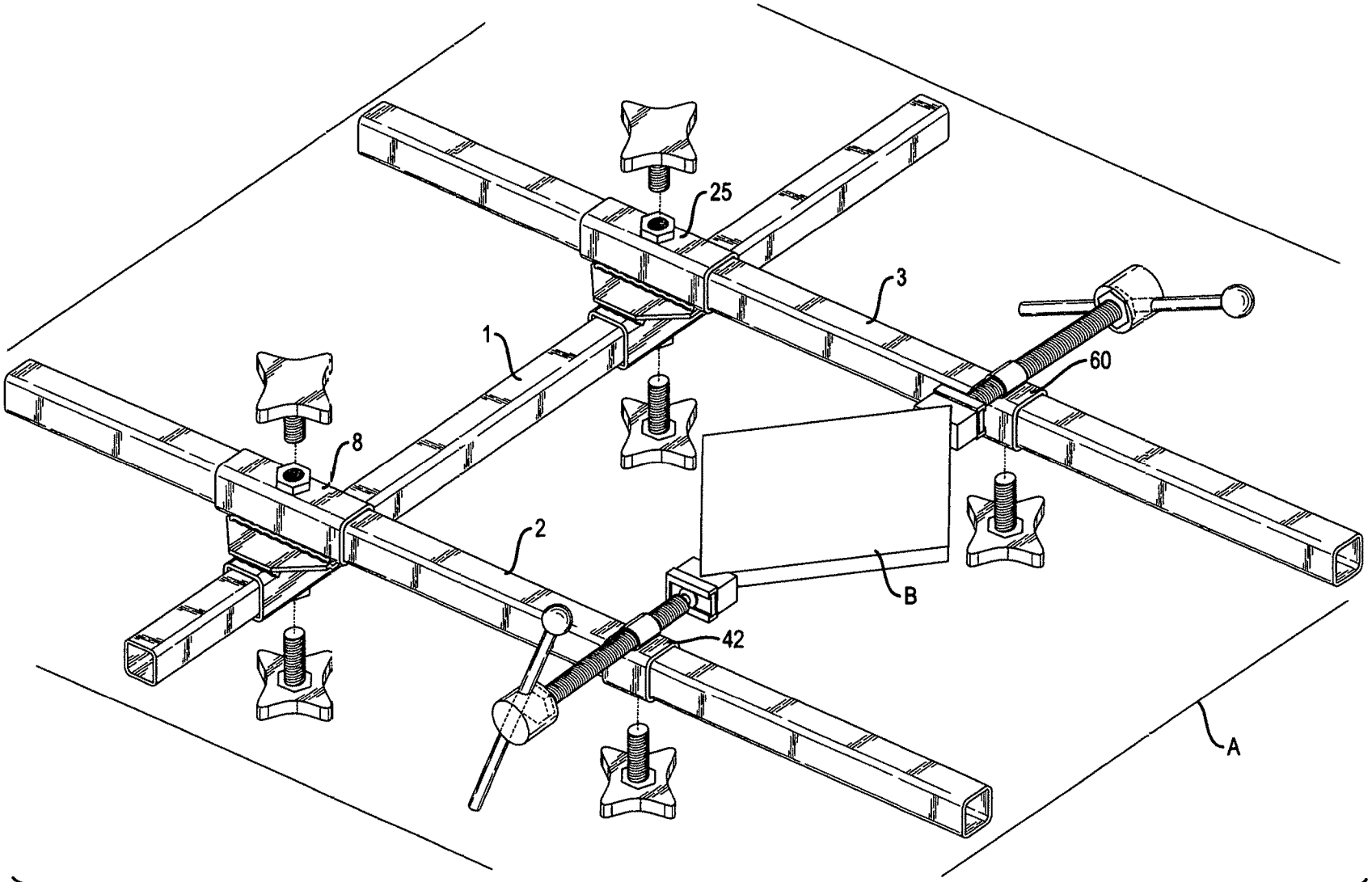
FIG. 1 depicts a first anteriorly profiled perspective view of the fully assembled invention holding work and seen resting on a work table.
Figure 2:
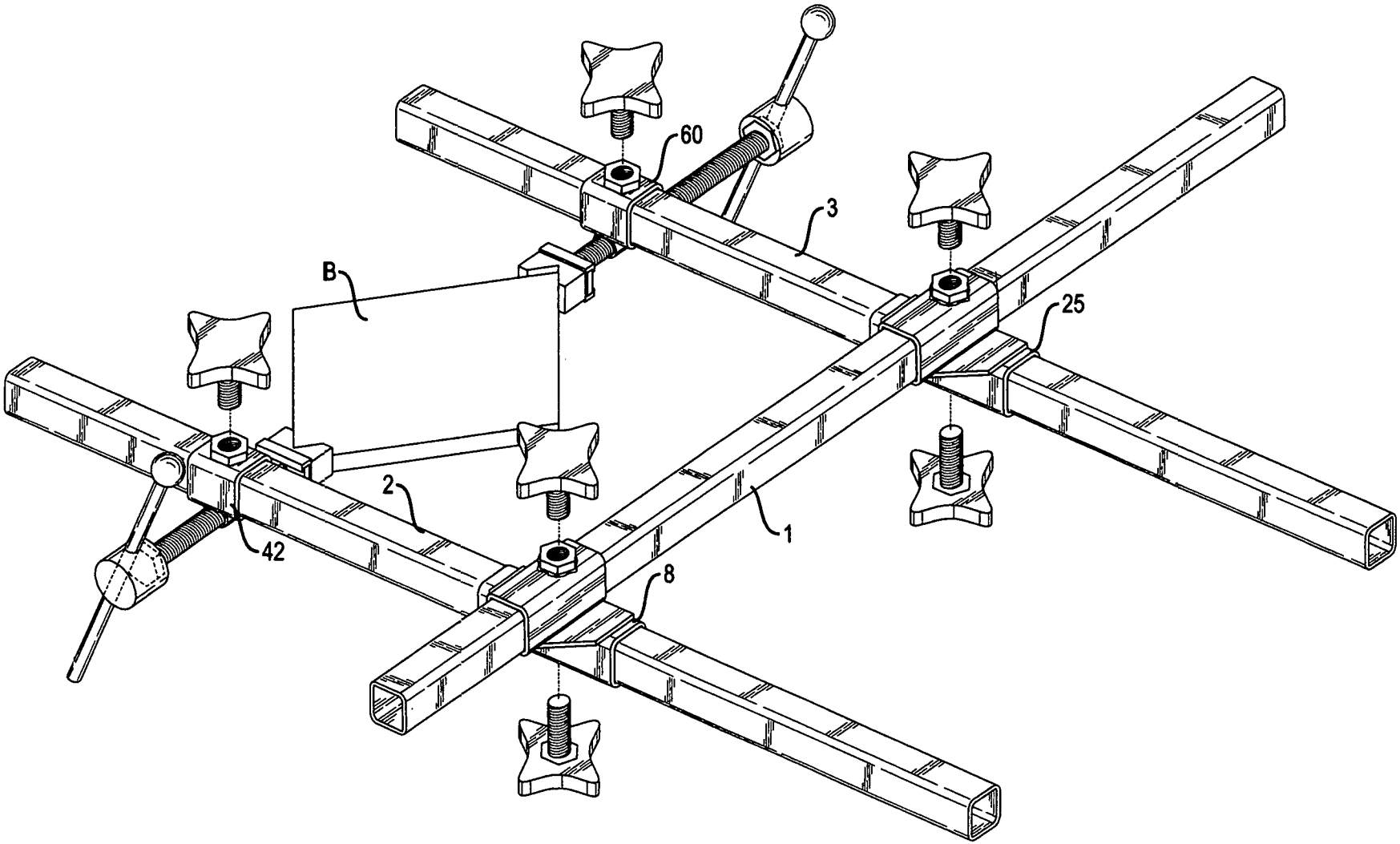
FIG. 2 depicts a posteriorly profiled perspective view of the fully assembled invention holding work and seen resting on a work table.
Figure 3:
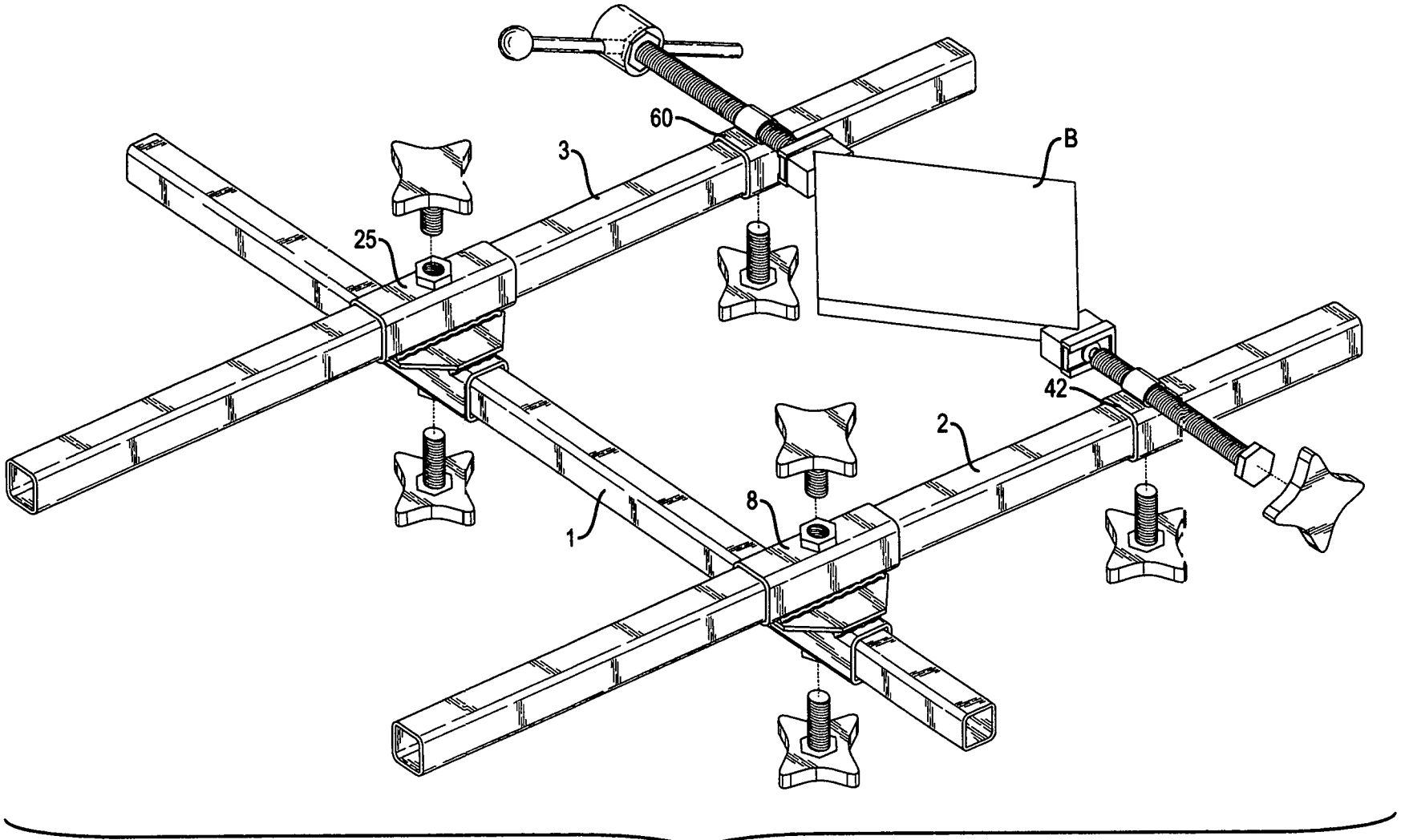
FIG. 3 depicts in isolated perspective view what is shown of the invention in FIG. 1, but, rotated through an angle of 90°.
Figure 4A:
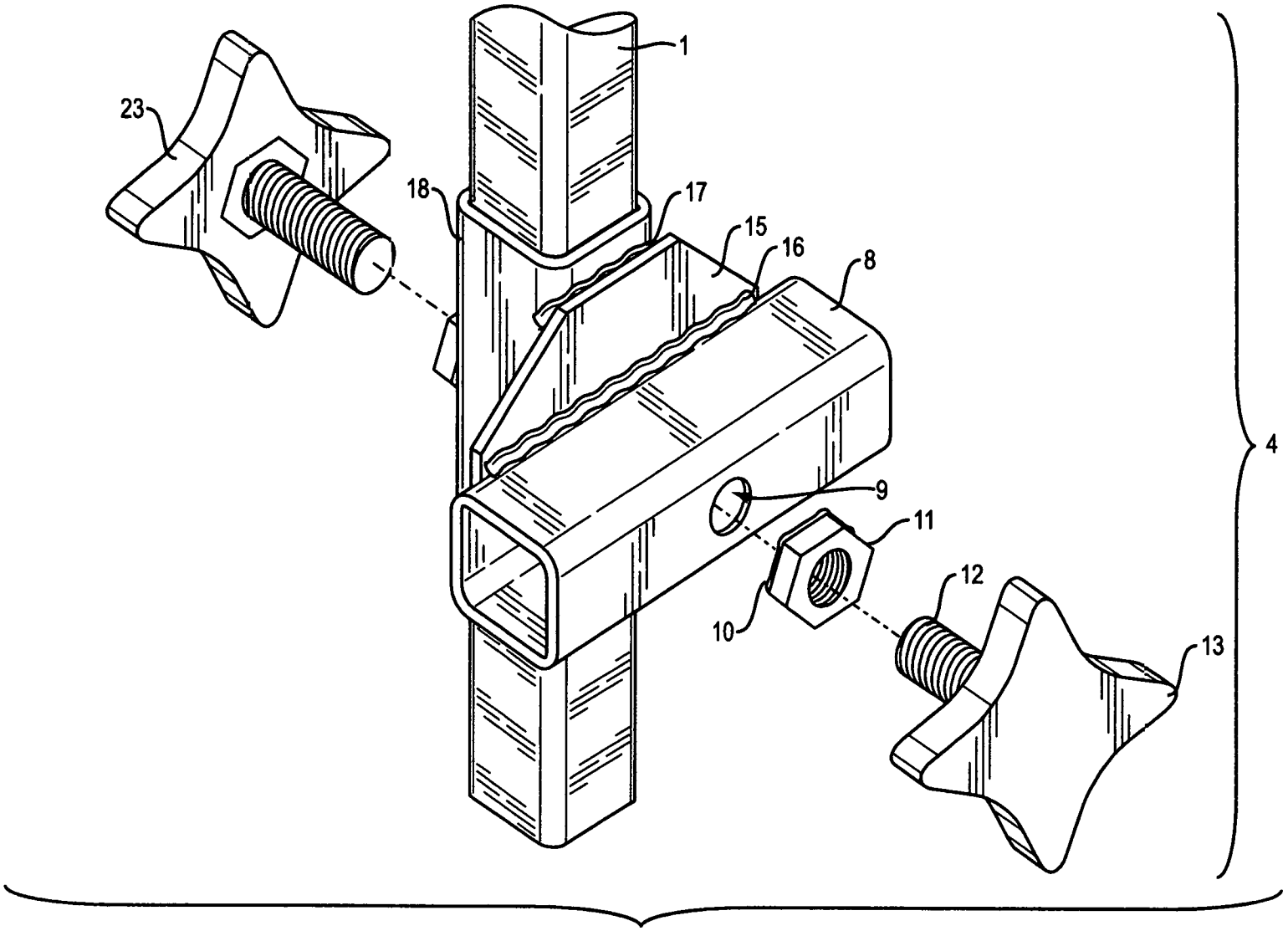
FIG. 4A depicts one profiled exploded view of the first two-way adjustable bar holder component of the invention.
Figure 4B:
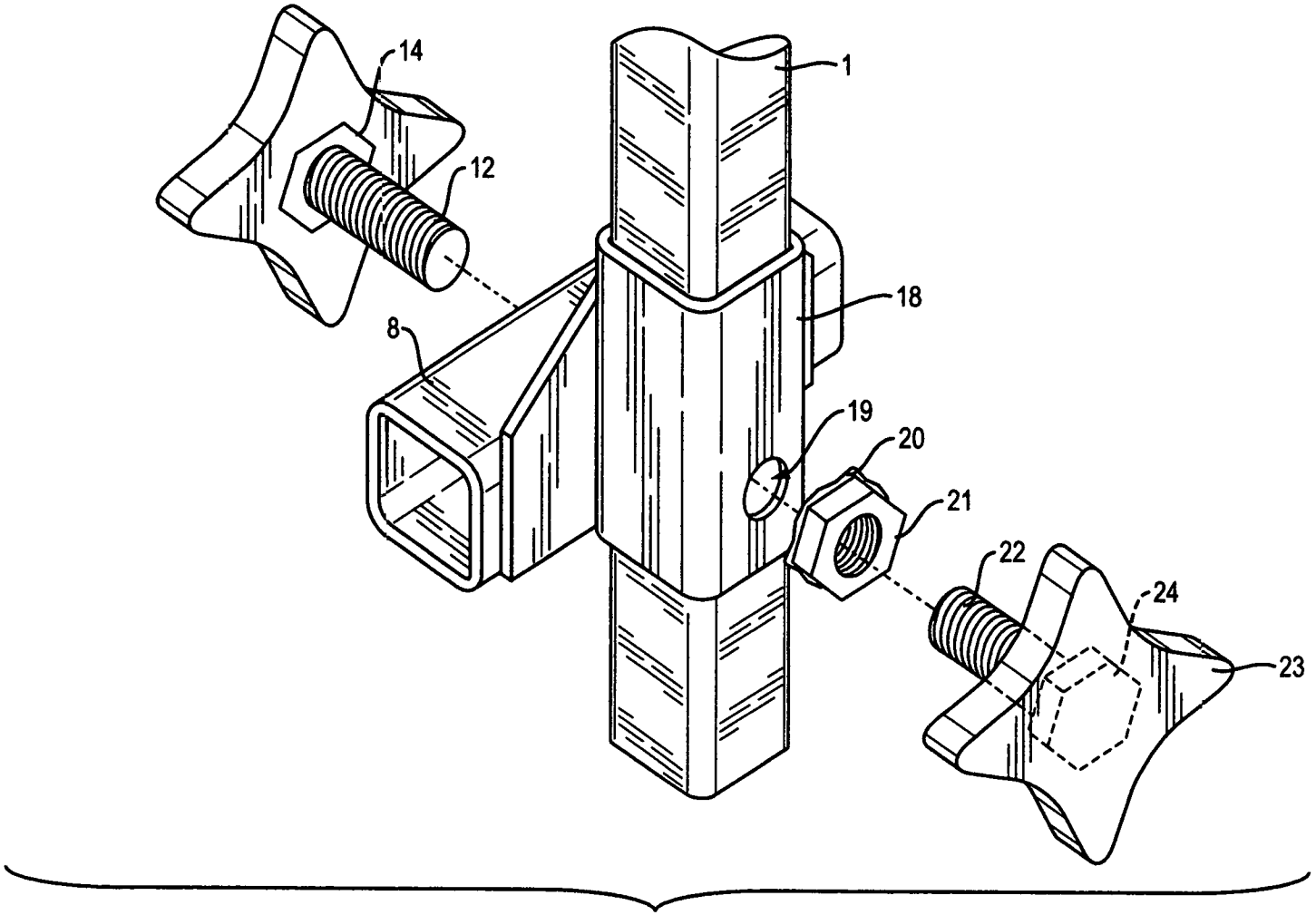
FIG. 4B depicts an oppositely inclined profiled exploded view of the first two-way adjustable bar holder component of the invention.
Figure 5A:
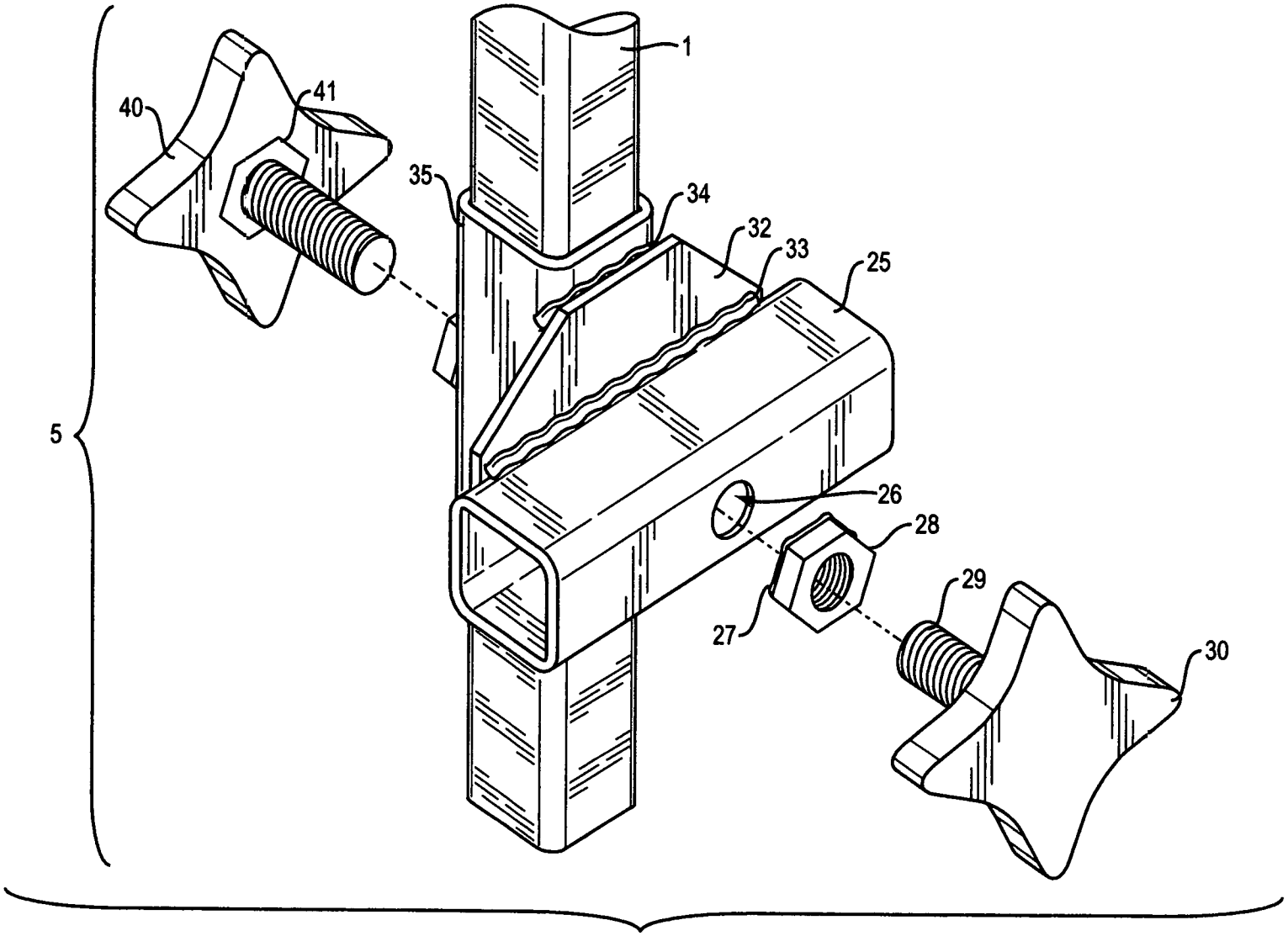
FIG. 5A depicts one profiled plan view of the second two-way adjustable bar holder component of the invention.
Figure 5B:
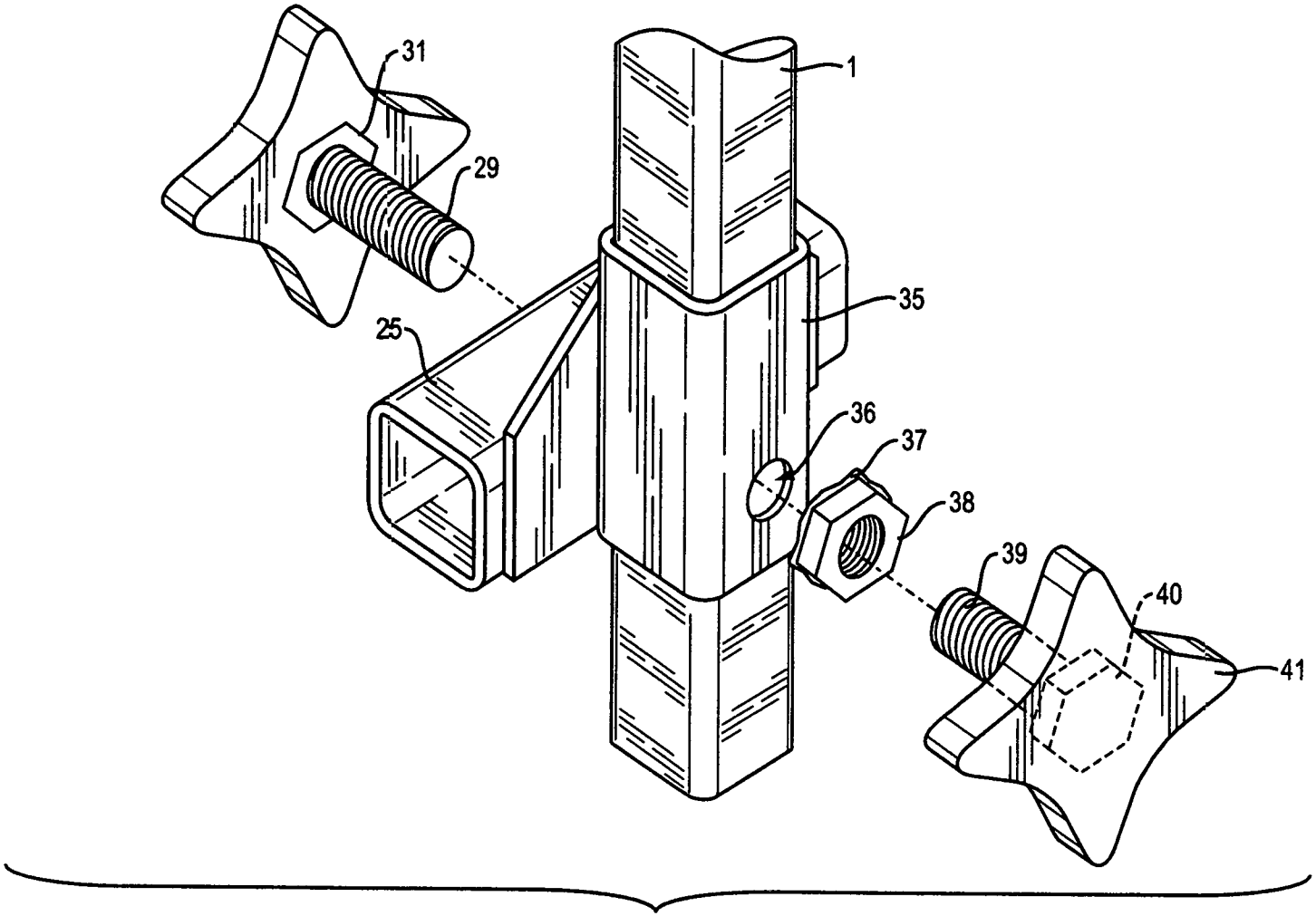
FIG. 5B depicts an oppositely inclined profiled exploded view of the second two-way adjustable bar holder component of the invention.
Figure 6:
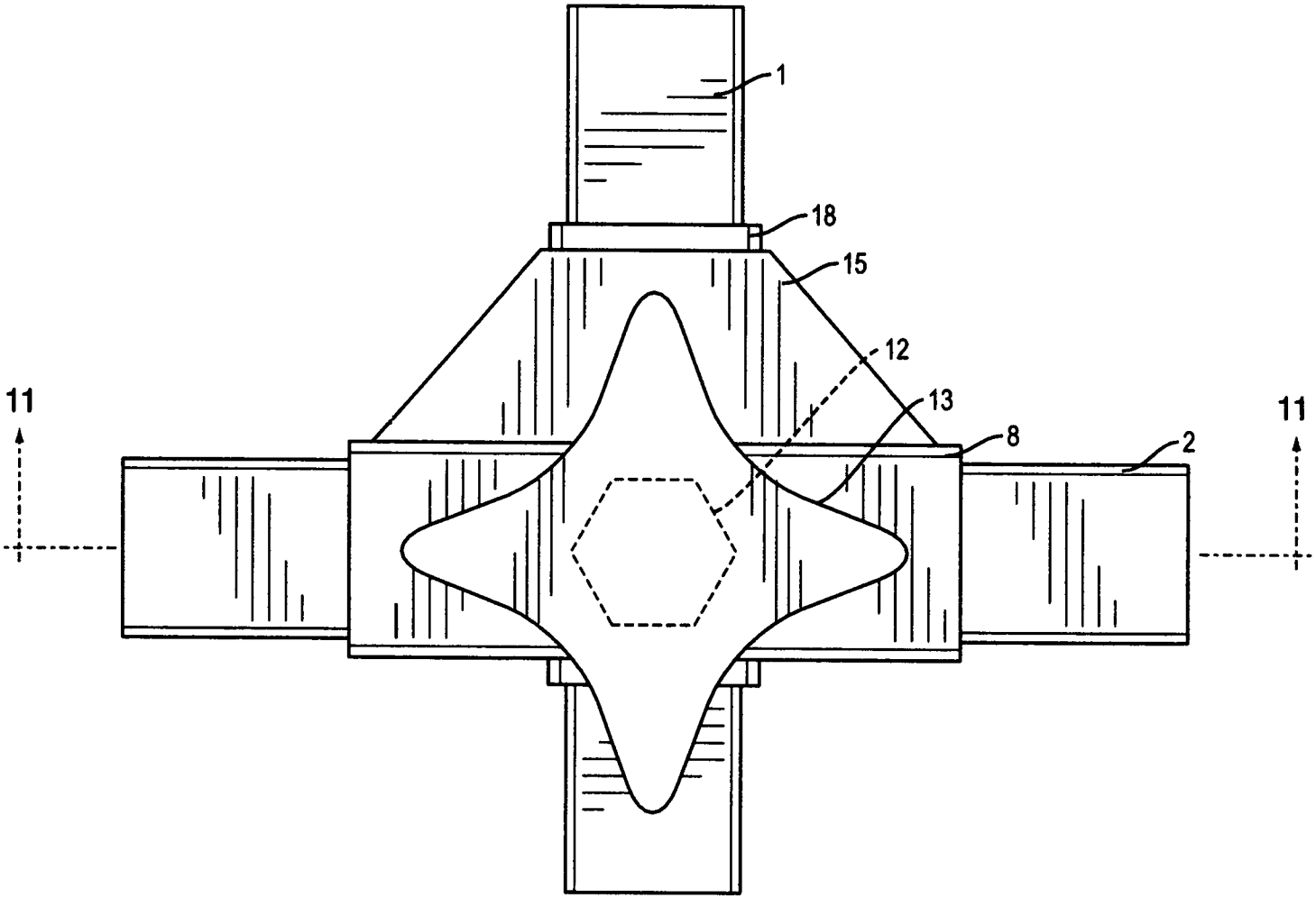
FIG. 6 depicts, in plan view, one of the two-way adjustable bar holder components of the invention.
Figure 7:
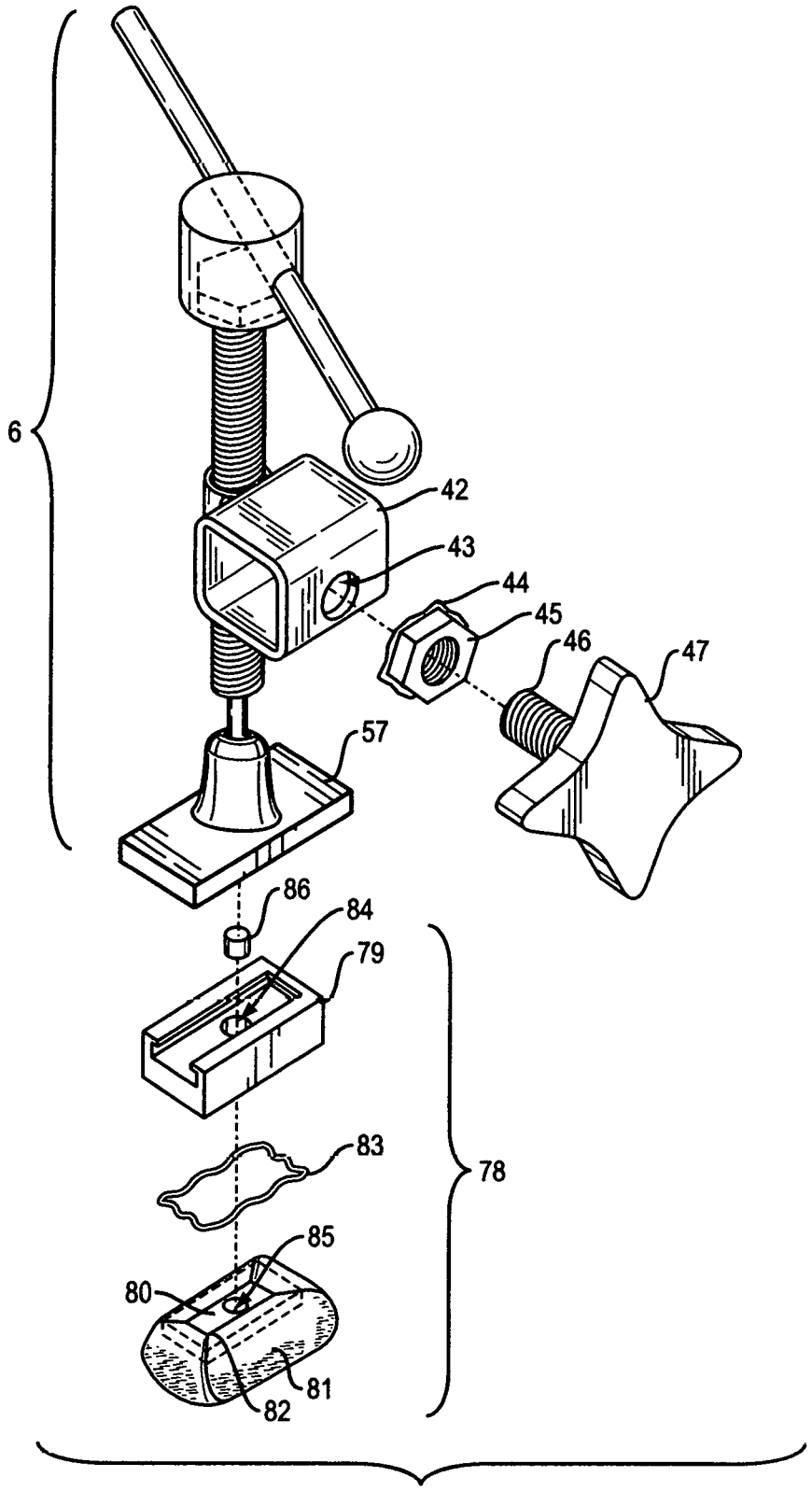
FIG. 7 depicts a profiled exploded view of the first one of the adjustable workholder components of the invention in apposition to a further exploded view of one of the tripartite sandbag shoe elements of the invention.
Figure 8A:
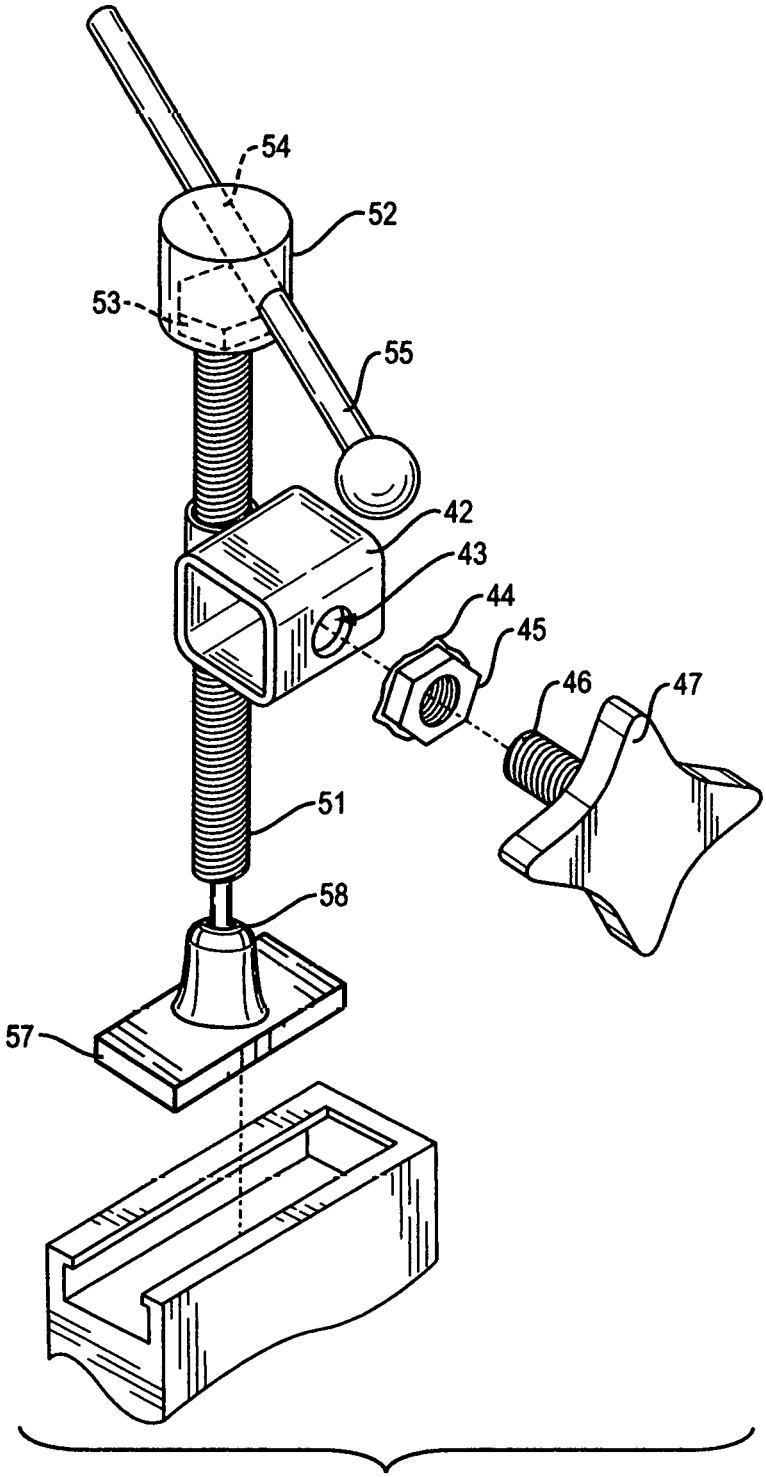
FIG. 8A depicts a profiled exploded view of the first one of the adjustable workholder components shown in FIG. 7, but now in apposition to a sleeving member portion of a shoe element of the invention.
Figure 8B:
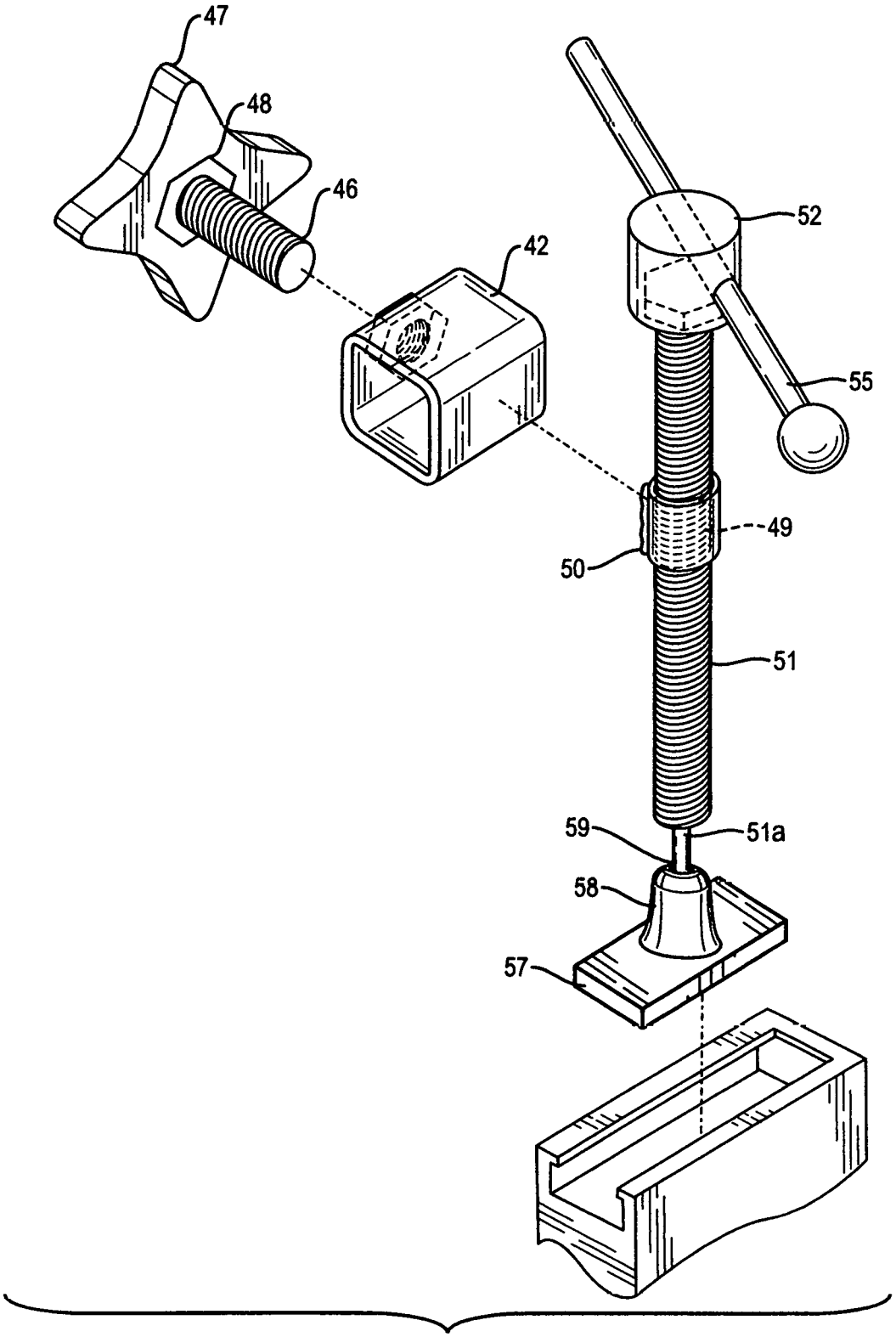
FIG. 8B depicts an oppositely inclined profiled exploded view of the first one of the adjustable workholder components of the invention and also in apposition to a sleeving member of a shoe element of the invention.
Figure 9A:
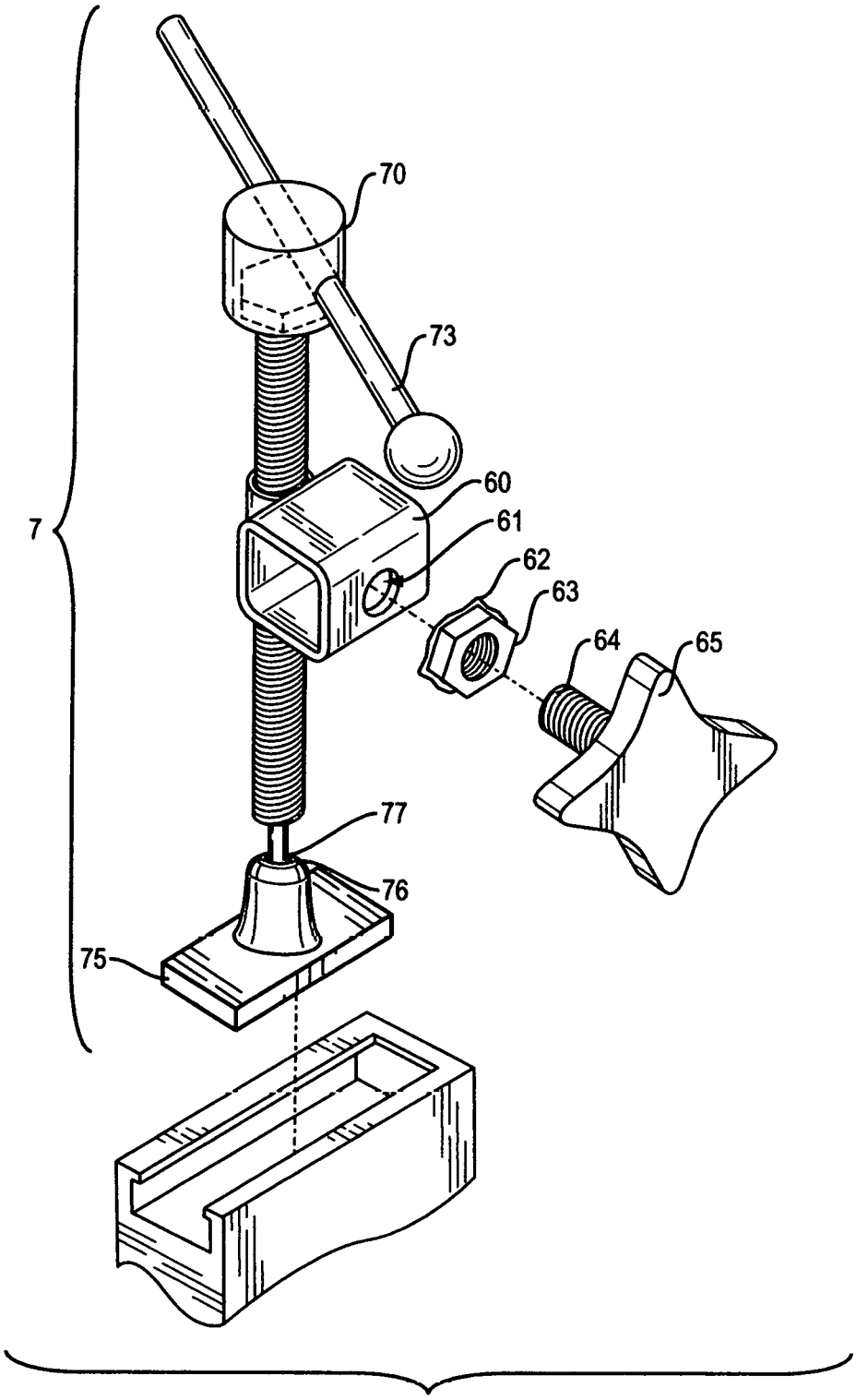
FIG. 9A depicts a profiled exploded view of the second one of the adjustable workholder components of the invention in apposition to a sleeving member portion of a shoe element of the invention.
Figure 9B:
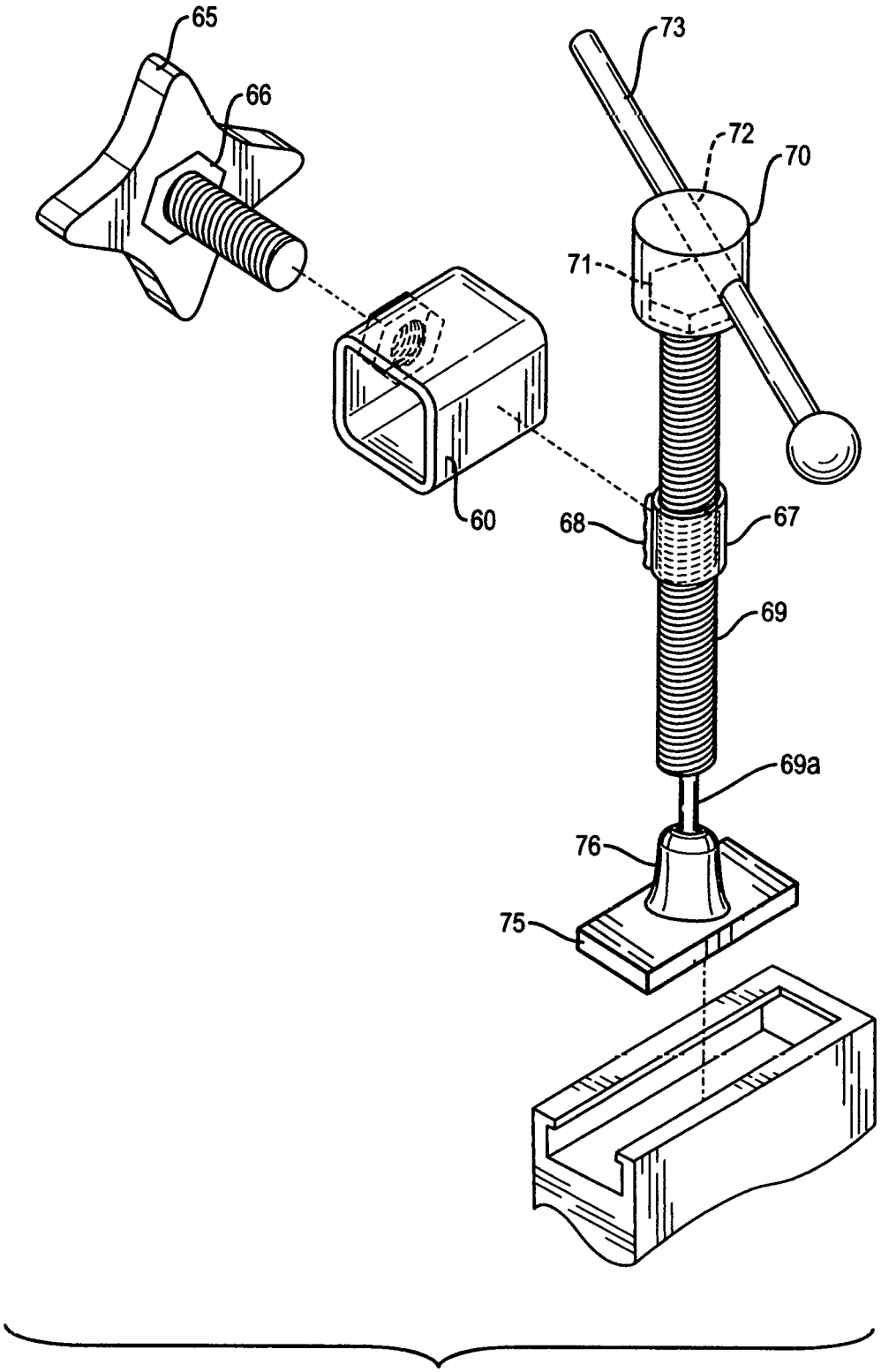
FIG. 9B depicts an oppositely inclined profiled exploded view of the second one of the adjustable workholder components of the invention and also in apposition to a sleeving member of a shoe element of the invention.
Figure 11:
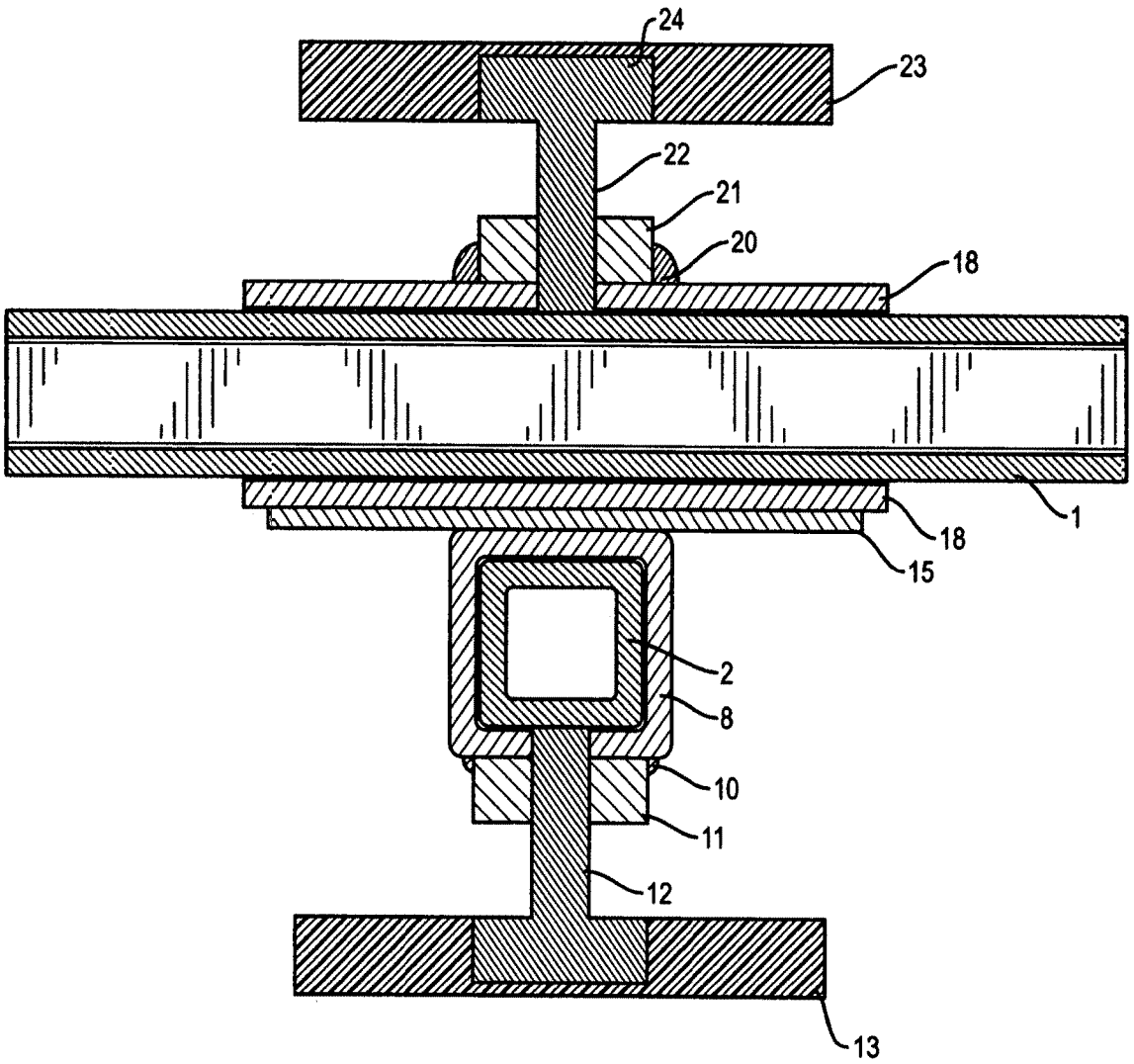
FIG. 11 is a cross-sectional view of the one of the two-way adjustable bar holder components of the invention such as is shown in FIG. 6.
Figure 12A:
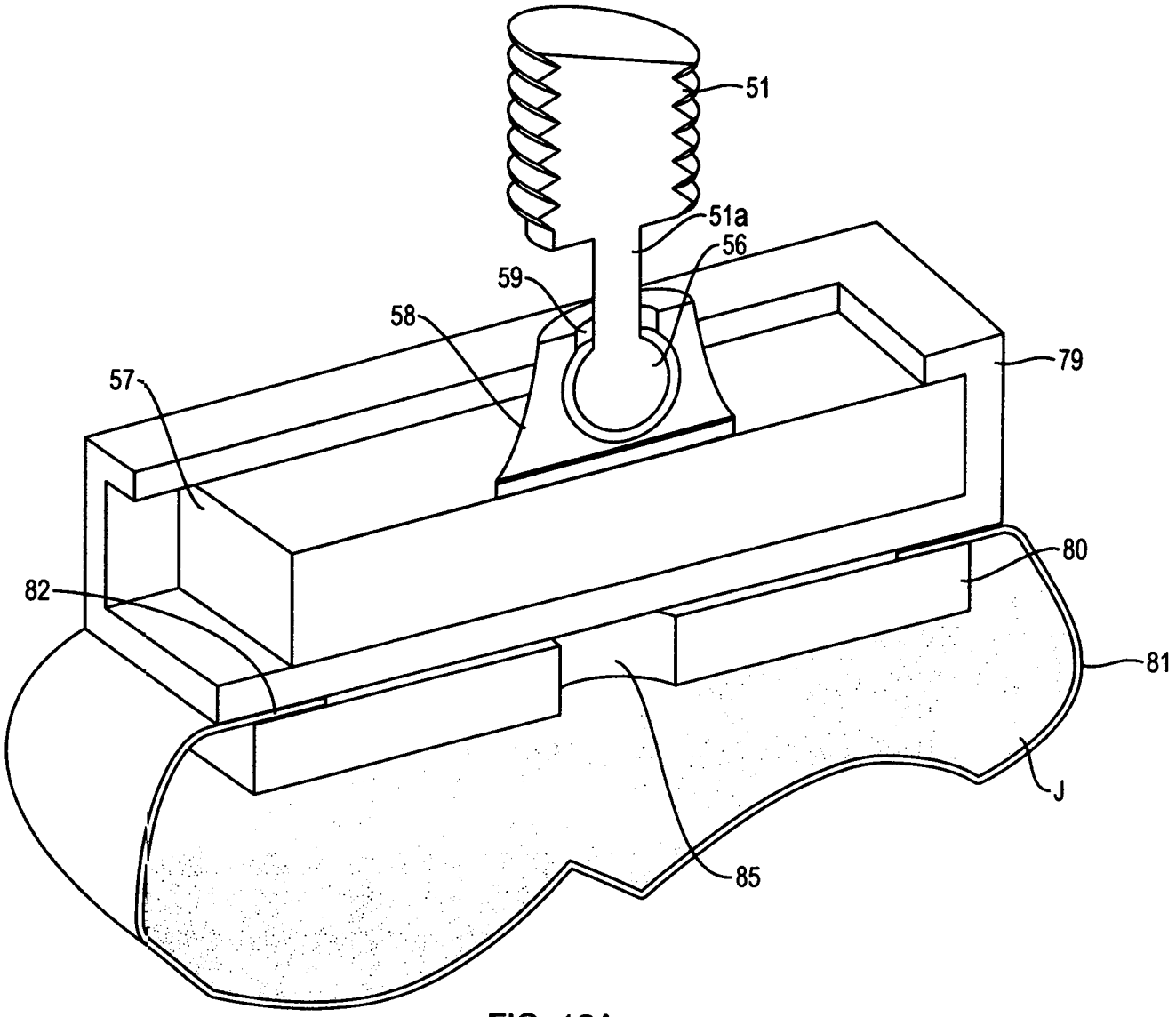
FIG. 12A is an isolated sagitally sectioned view of one of the tripartite shoe elements of the invention being held by a shoeholder element in turn being held about the ball shaped end portion of the small metallic base rod extension member of the holding bolt of one of the workholder components of the invention.
Figure 12B:
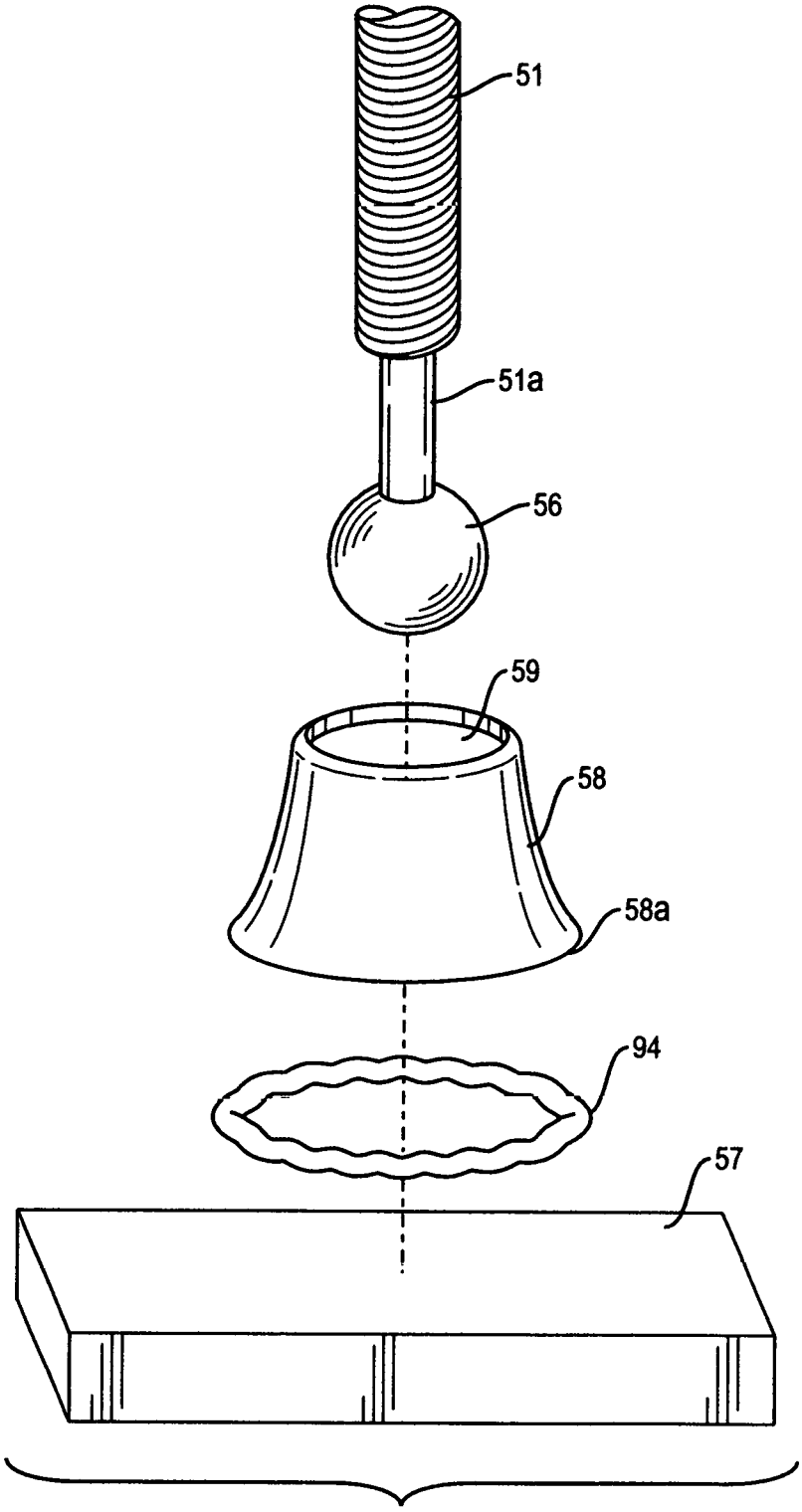
FIG. 12B shows, in exploded view, the housing unit within which the ball shaped end portion of the base rod extension member of one of the holding bolts is meant to be ultimately rotatably held.
Figure 12C:
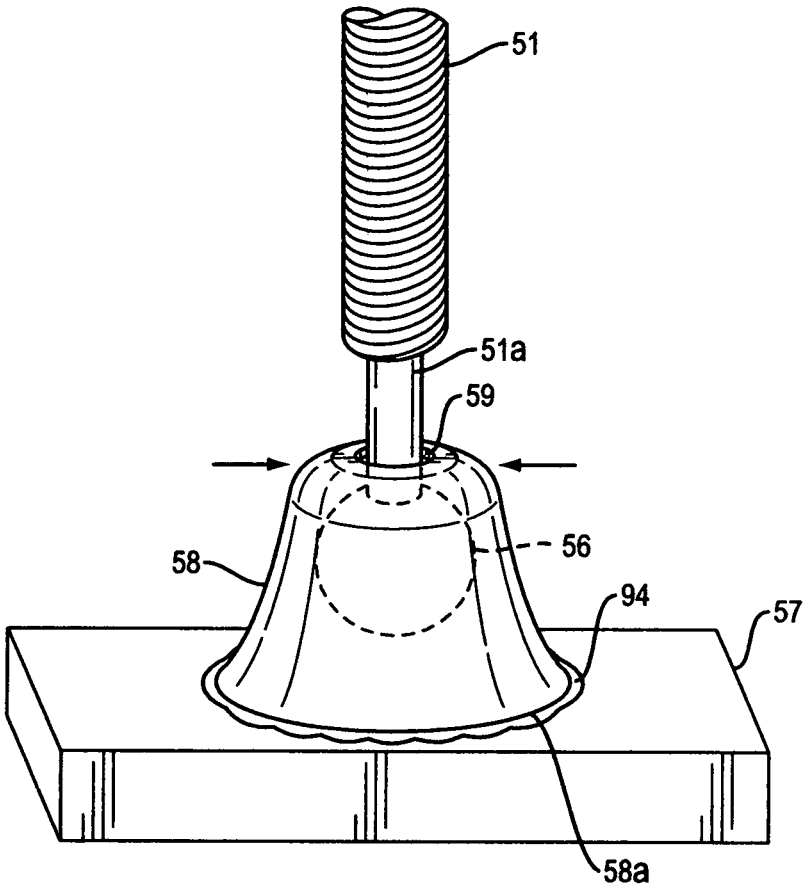
FIG. 12C shows the housing unit within which the ball shaped end portion of the base rod extension member all as seen in FIG. 12B is rotatably held after the superior hole of the housing unit is crimped.
Figure 12D:
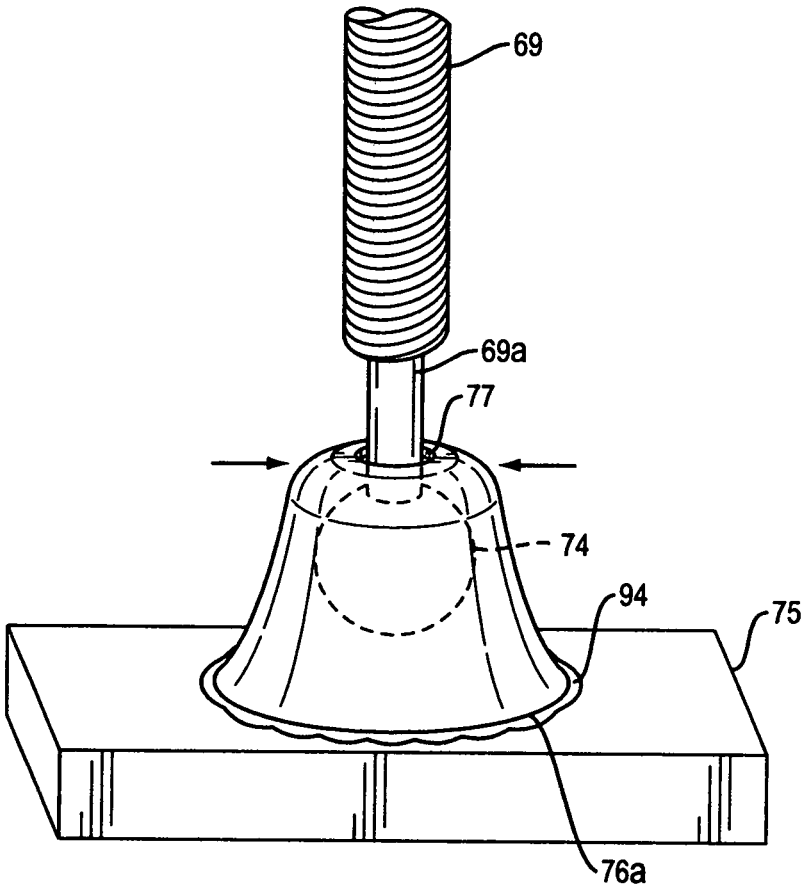
FIG. 12D shows the other housing unit within which the ball shaped end portion of the base rod extension member of the other of the holding bolts is rotatably held after the superior hole of the housing unit is crimped.

FIG. 1 serves to depict the whole of the invention resting atop a Table A and holding a piece of wood B. FIG. 2, an isolated perspective view of the invention, depicts what is seen in FIG. 1 once what is seen in FIG. 1 is rotated vertically through an angle of 180°. FIG. 3 also depicts in isolated perspective view what is seen of the invention in FIG. 1 when what is so shown of the invention in FIG. 1 is rotated horizontally through an angle of 90°. These three figures facilitate an appreciation for the shapes of vertically inclined metallic support bar 1 and horizontally inclined metallic crossbars 2 and 3 from varied vantage points. FIG. 1 and FIG. 2 serve to portray both sides of each of first two-way adjustable bar holder component 4, which is shown in appropriate detail in FIGS. 4A and 4B and second two-way adjustable bar holder component 5, which is shown in appropriate detail in FIGS. 5A and 5B. First horizontally inclined bar holding metallic sleeving element 8 of component 4 and second horizontally inclined bar holding metallic sleeving element 25 of component 5 are so signed in each of FIGS. 1 and 2. Third horizontally inclined bar holding metallic sleeving element 42 of first adjustable workholder component 6, shown in appropriate detail in FIGS. 7, 8A and 8B, is seen from vantage points of both sides of component 6 in FIGS. 1 and 2. Finally, fourth horizontally inclined sleeving element 60 of second workholder component 7, shown in appropriate detail in FIGS. 9A and 9B, is seen from vantage points of both sides of component 7 also in FIGS. 1 and 2. As is apparent with reference to the aforementioned figures, components 4 and 5 are equivalently sized ideally, though not necessarily and are positionally interchangeable with one another. The same holds true as respects components 6 and 7. With reference to FIG. 4A, component 4 is characterized by the presence of metallic sleeving element 8 amenable to receipt of crossbar 2 and there is also therein shown first vertically inclined bar holding metallic sleeving element 18 holding vertically inclined support bar 1. There is a hole 9 in element 8. First internally threaded nut 11 is held via weld 10 fast to a first side of element 8 about hole 9. Nut 11 receives first externally threaded bolt 12, the head portion of which is press fitted into a closed hole 14 found centrally positioned within first turning handle unit 13. Hole 14 is depicted in FIG. 4B which is the equivalent of FIG. 4A rotated horizontally through 180°. First metallic anchoring plate 15 is welded via second weld 16 to the second side of element 8 and, in turn also welded via third weld 17 to the first side of element 18 as can be appreciated with reference to FIG. 4A and also with reference to FIG. 4B. Fourth weld 20 seen in FIG. 4B serves to cause second internally threaded nut 21 to be held fast to element 18 about hole 19. Nut 21 serves to receive second externally threaded bolt 22, the head portion of which is press fitted first into closed hole 24, centrally positioned within second metallic turning handle unit 23. Hole 24 as shown in FIG. 4B is an exact replica of hole 14. FIGS. 5A and 5B depict in detail, component 5. Component 5 is characterized by the presence of metallic sleeving element 25 amenable to receipt of crossbar 3 and there is also therein shown second vertically inclined bar holding metallic sleeving element 25 holding vertically inclined support bar 1. There is a hole 26 within element 25. Third internally threaded nut 28 is held fast via fifth weld 27 to the first side of sleeving element 25 about hole 26. Nut 28 receives third externally threaded bolt 29, the head portion of which is press fitted first into closed hole 31, centrally positioned within third metallic turning handle unit 30. Hole 31 is appreciated with reference to FIG. 5B. Second metallic anchoring plate 32 is welded via sixth weld 33 to the second side of element 25 and in turn is welded via seventh weld 34 to the first side of element 35 as can be appreciated with reference to FIG. 5A. Also, with reference to FIG. 5B, eighth weld 37 serves to cause fourth internally threaded nut 38 to be held fast to sleeving element 35 about hole 36. Nut 38 serves to receive fourth externally threaded bolt 39, the head portion of which is press fitted fast into closed hole 41, centrally positioned within fourth metallic turning handle unit 40. Hole 41 as can be appreciated with reference to FIG. 5B is an exact replica of hole 31. FIG. 6 is a plan view of what is seen in FIG. 4A as regards component 4 but with the addition of a plan view of crossbar 2 held within sleeving element 8. FIG. 11 is a cross-sectional visualization of what is shown in FIG. 6. It should be noted that drawings of the order of FIGS. 6 and 11 would have appeared exactly as do FIGS. 6 and 11, had such drawings been generated with reference to component 5 except as respects the signage appropriate as respects component 5 as would have then been provided in respect of any such drawings. FIGS. 7, 8A and 8B serve to depict with particularity, first adjustable workholder component 6 of the invention. Component 6 features third horizontally inclined metallic sleeving element 42 for receipt of crossbar 2 as seen, e.g., in FIG. 1. There is a hole 43 in the first side of element 42. A ninth weld 44 serves to hold a fifth internally threaded nut 45 fast to element 42 about hole 43. Fifth externally threaded bolt 46 is press fitted about a head portion thereof into a centrally positioned closed hole 48 appreciated with reference to FIG. 8B and which is found within fifth metallic turning handle unit 47. Component 6 with reference to FIG. 8B also features a first elongated internally threaded bolt holder unit 49 which is welded via a tenth weld 50 to the second side of element 42. Unit 49 serves to hold a first elongated vertically inclined holding bolt 51, which bolt 51 features, as well, a metallic first base rod extension member portion 51*a* thereof extending downwardly from the base bottom segment of bolt 51. Component 6 also features a first metallic turning cap unit 52. There is a centrally positioned closed hole 53 within cap unit 52 signed in FIG. 7 for press fitted receipt of the head portion of bolt 51. There is also a first superior through hole 54 signed in FIG. 7 as being within cap 52. Hole 54 is horizontally inclined and serves to slideably receive first metallic turning rod 55. There is moreover a metallic ball shaped lower end portion 56, appreciated with reference to FIG. 12C of the base rod extension member portion 51*a* of bolt 51 as seen in FIG. 12A and FIG. 12B. End portion 56 serves to rotatably hold first solid metallic shoeholder element 57 as follows. First end portion hollow metallic housing unit 58 features a first superiorly positioned hole 59 all as shown, e.g., in FIG. 12A and FIG. 12B. Once end portion 56 is inserted into housing unit 58 through hole 59, then the edging of unit 58 about hole 59 is crimped in a manner as is shown in FIG. 12C and crimped in such a manner as to thereby render the greatest crosswise breadth thereof as then being less than the diameter of end portion 56 so that end portion 56 is then loosely and rotatably held within the hollow lumen of housing unit 58. The base brim portion 58*a* signed in FIG. 12B of unit 58 is then soldered with solder material 94 to the topside of shoeholder element 57. FIGS. 9A and 9B serve to depict with particularity, second adjustable workholder component 7 of the invention. Component 7 features fourth horizontally inclined metallic sleeving element 60 for receipt of crossbar 3 as seen, e.g., in FIG. 1. There is hole 61 in the first side of sleeving element 60. An eleventh weld 62 serves to hold a sixth internally threaded nut 63 fast to element 60 about hole 61. Sixth externally threaded bolt 64 is press fitted about a head portion thereof into a centrally positioned closed hole 66 seen in FIG. 9B within sixth metallic turning handle 65. Component 7 also features a second elongated internally threaded bolt holder unit 67 which is welded via a twelfth weld 68 to the second side of element 60. Unit 67 serves to hold a second elongated vertically inclined holding bolt 69 which bolt 69 features, as well, a metallic base rod extension member portion 69*a* thereof extending downwardly from the base bottom segment of bolt 69. Component 7 also features a second metallic turning cap unit 70. There is a centrally positioned closed hole 71 within cap unit 70 for press fitted receipt of the head portion of bolt 69. There is also a second superior through hole 72 within cap unit 70. Hole 72 is horizontally inclined and serves to slideably receive second metallic turning rod 73. There is a metallic ball shaped lower end portion 74, appreciated with reference to FIG. 12D of the base rod extension member 69*a* of bolt 69. Second end portion 74 serves to rotatably hold second solid metallic shoeholder element 75 as follows. Second end portion hollow metallic housing unit 76 features a superiorly positioned hole 77 with the ultimate greatest crosswise breadth thereof being less than the diameter of end portion 74. Once end portion 74 is inserted into housing unit 76 through hole 77, then the edging of unit 76 about hole 77 is crimped, all as is shown with particularity in FIG. 12D, in such a manner as to thereby render the greatest crosswise breadth thereof smaller than the diameter of end portion 74 so that end portion 74 is then loosely and rotatably held within the hollow lumen of housing unit 76 The base brim portion 76*a* of unit 76 is then soldered with solder material 94 to the topside of shoeholder element 75. The crimping about hole 77 for holding end portion 74 is the same as the crimping about hole 59 for holding end portion 56.

Figure 10A:
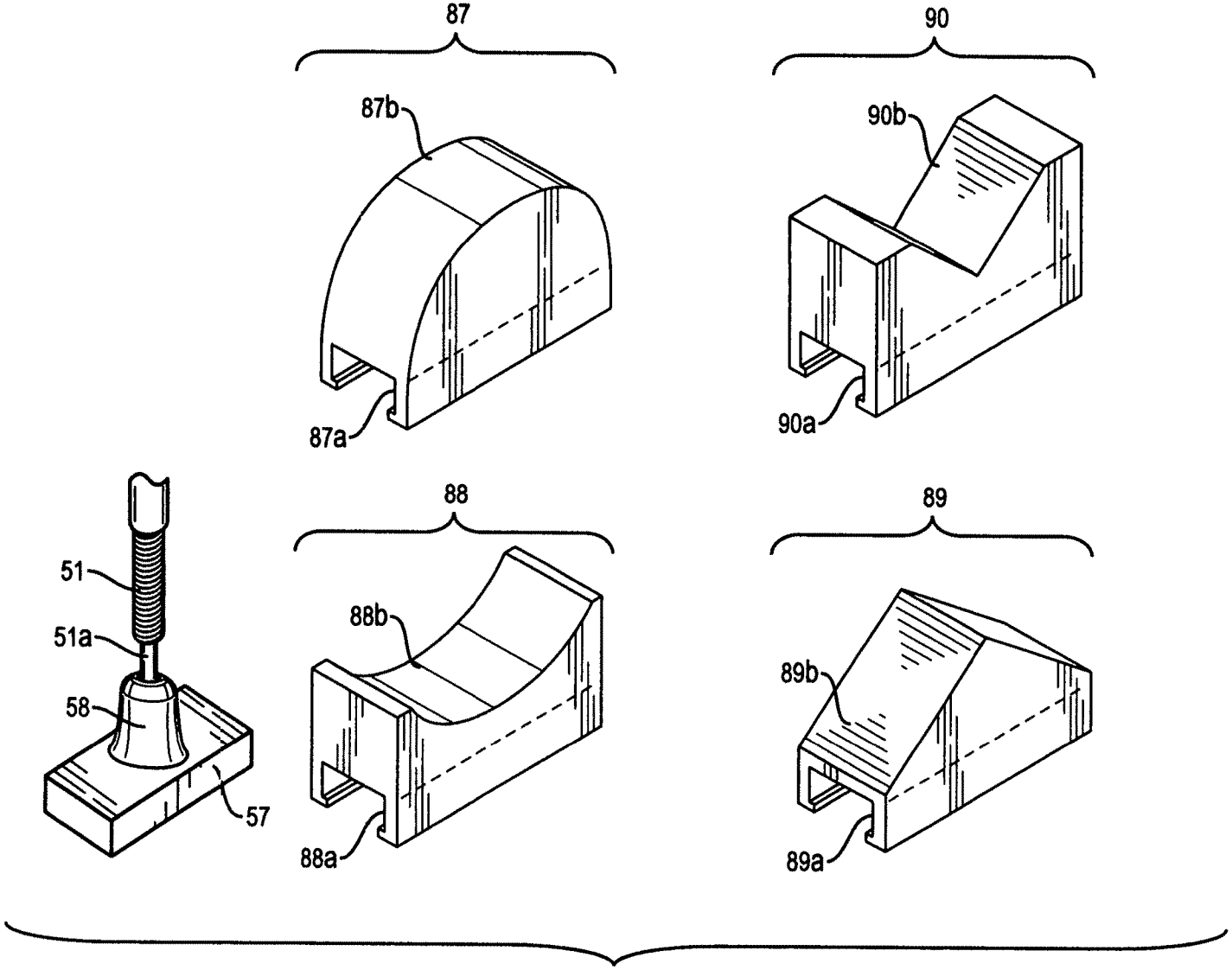
FIG. 10A depicts in perspective view, four of the various shoe elements of the invention and likewise the first one of the shoeholder elements thereof.
Figure 10B:
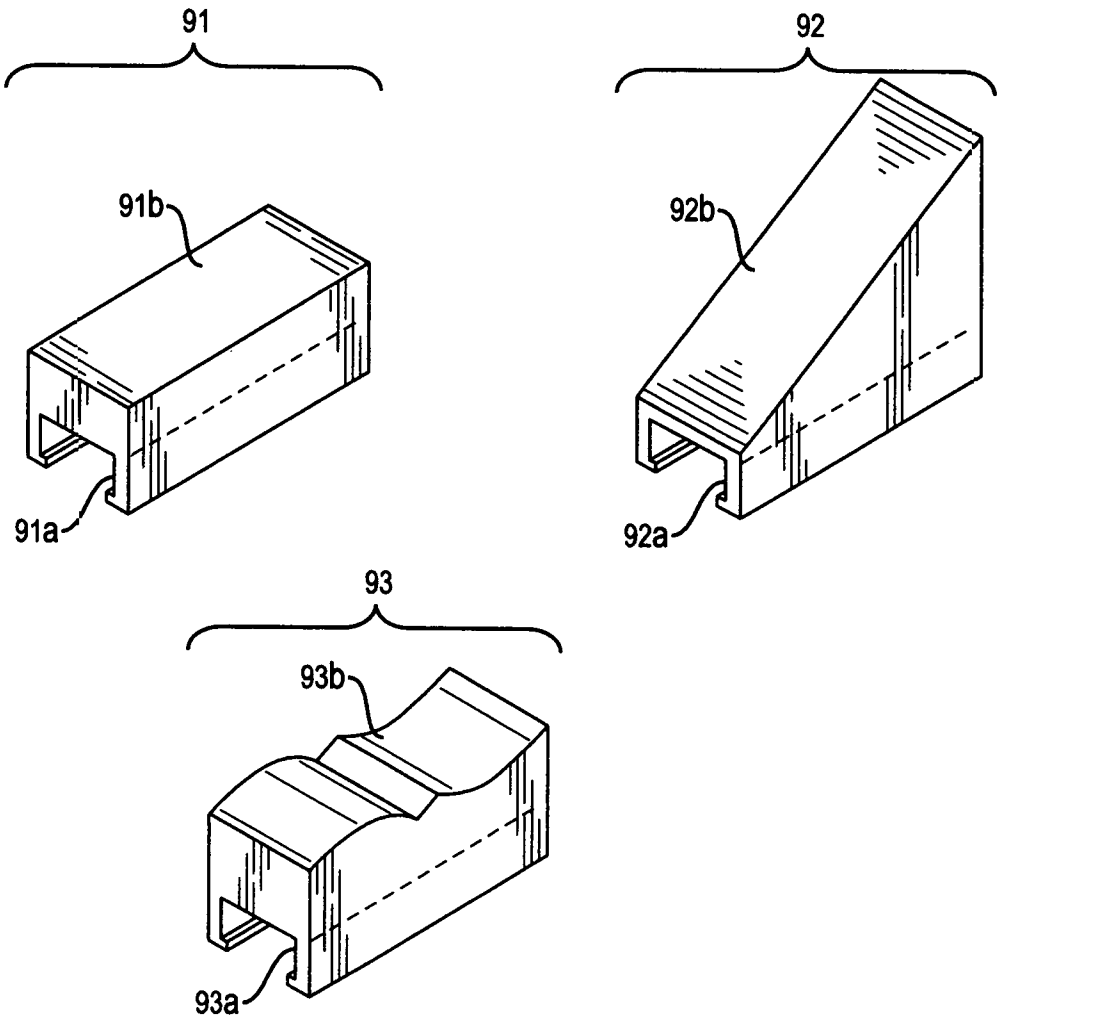
FIG. 10B depicts in perspective view, three of the various shoe elements of the invention and likewise the second one of the shoeholder elements thereof.
Figure 13:
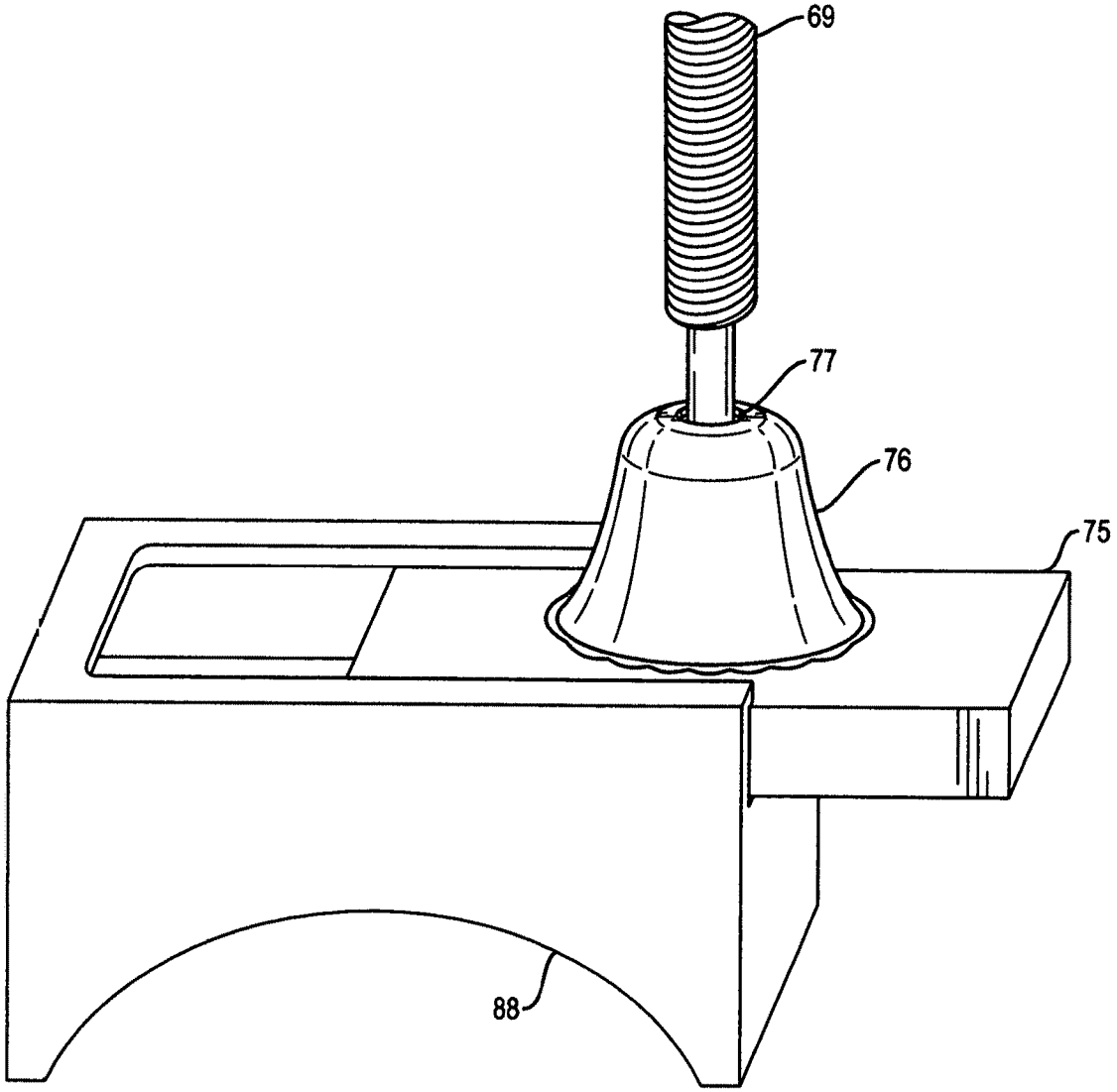
FIG. 13 is an isolated perspective view of one of the shoe elements of the invention being held within the sleeving member thereof by one of the shoeholder elements and further being rotatably held about the ball shaped end portion seen in FIG. 12.

The above described components and elements of the invention are the hallmarks of the preferred embodiment thereof. There are however variations of the preferred embodiment that can be noted with reference to the various forms of shoe elements thereof such as can be appreciated with reference to FIGS. 7, 10A, 10B and 12A. FIGS. 7 and 12A depict the essence of one of the two equivalent sandbag shoe elements 78 of the invention. Each sandbag shoe element 78 is tripartite in nature. A first variant of the preferred embodiment features resort to two such shoe elements 78, one of which is seen in exploded view in FIG. 7 and two of which are shown intact in and in use in FIG. 22. Each element 78 is made up of a metallic or wooden or hard rubberlike material sleeving member portion 79 amenable to receiving either first shoeholder element 57 or second shoeholder element 75. Each element 78 has a medially positioned solid flat base member 80 being metallic or wooden or hard rubberlike and a typically made up of sturdy cloth like material sandbag member Member 81 has upper edging 82. Glue adhesive material 83 serves to affix upper edging 82, once inwardly furled about the topside of member 80, to the topside of member 80 and also to the bottomside of member portion 79 with edging 82 then sandwiched in between the topside of member 80 and the bottomside of member portion 79. There is a central through hole 84 in member portion 79 and a central through hole 85 in member 80. Sand material J is introduced through holes 84 and 85 within a fully assembled element 78 so as fill sandbag member 81 with sand J. Once member 81 is sufficiently filled with sand J, then peg unit 86 appropriately sized to holes 84 and 85 is press fitted or hammered into holes 84 and 85 so as to thereby prevent sand J from thereafter escaping from member 81. FIG. 12A depicts cross-sectionally an intact tripartite shoe element 78. A second variant of the invention features utilization of the various other forms of solid shoe elements either metallic or wooden or made up of hard rubberlike material and such as are shown in FIGS. 10A and 10B. Such shoe elements are all solidly shaped and are so utilized, two at any given time. One of the same, a first one of such shoe elements, is held by shoeholder element 57, while another one of the same, a second shoe element is correspondingly held by shoeholder element 75. Each such shoe element features a sleeving member portion constructed similarly to the sleeving member portion 79 of either of tripartite shoe elements 78. Each of the shoe elements depicted in FIGS. 10A and 10B differs from one another insomuch as each features a variably shaped base member portion. The sleeving member portion of each such shoe element facilitates ready slideable receipt of either shoeholder element 57 or shoeholder element 75. FIGS. 10A and 10B depict the following various shoe elements. The dotted lines shown in the depictions of the various shoe elements seen in FIGS. 10A and 10B serve to delineate in each a locus of demarcation as between the sleeving member portion and base member portion of each such shoe element. Such dotted lines serve to depict the flooring of the sleeving member portion of each such shoe element. Shoe element 87 has a sleeving member portion 87*a* and a base member portion 87*b* that is convexly rounded in shape. Shoe element 88 has a sleeving member portion 88*a* and a base member portion 88*b* that is concavely rounded in shape. Shoe element 89 has a sleeving member portion 89*a* and a base member portion 89*b* that is convexly triangular in shape. Shoe member 90 has a sleeving member portion 90*a* and a base member portion 90*b* that is concavely triangular in shape with anterior and posterior outer edging. Shoe member 91 has a sleeving member portion 91*a* and a base member portion 91*b* that is flat sided in shape. Shoe member 92 has a sleeving member portion 92*a* and a base member portion 92*b* that is right triangular in shape. Shoe member 93 has a sleeving member portion 93*a* and a base member portion 93*b* that is wavy irregular in shape. A third variant of the invention features utilization of a shoe element 78 being held via sleeving member portion 79 thereof by either shoeholder element 57 or shoeholder element 75 and one of the shoe elements, typically shoe element 91, shown in FIGS. 10A and 10B, and being correspondingly held by the sleeving member portion 91*a* thereof to the other of shoeholder element 57 or shoeholder element 75. A pictorial depiction of the second variant of the invention is to be seen with resort to FIGS. 14-17, 19-21. A pictorial depiction of the third variant of the invention is to be seen with resort to FIG. 18. FIG. 13 exemplifies the manner in which a sleeving member portion of a shoe element serves to slideably receive either one of the two shoeholder elements 57, 75 of the invention, in this instance, shoeholder element 57.

Figure 14:
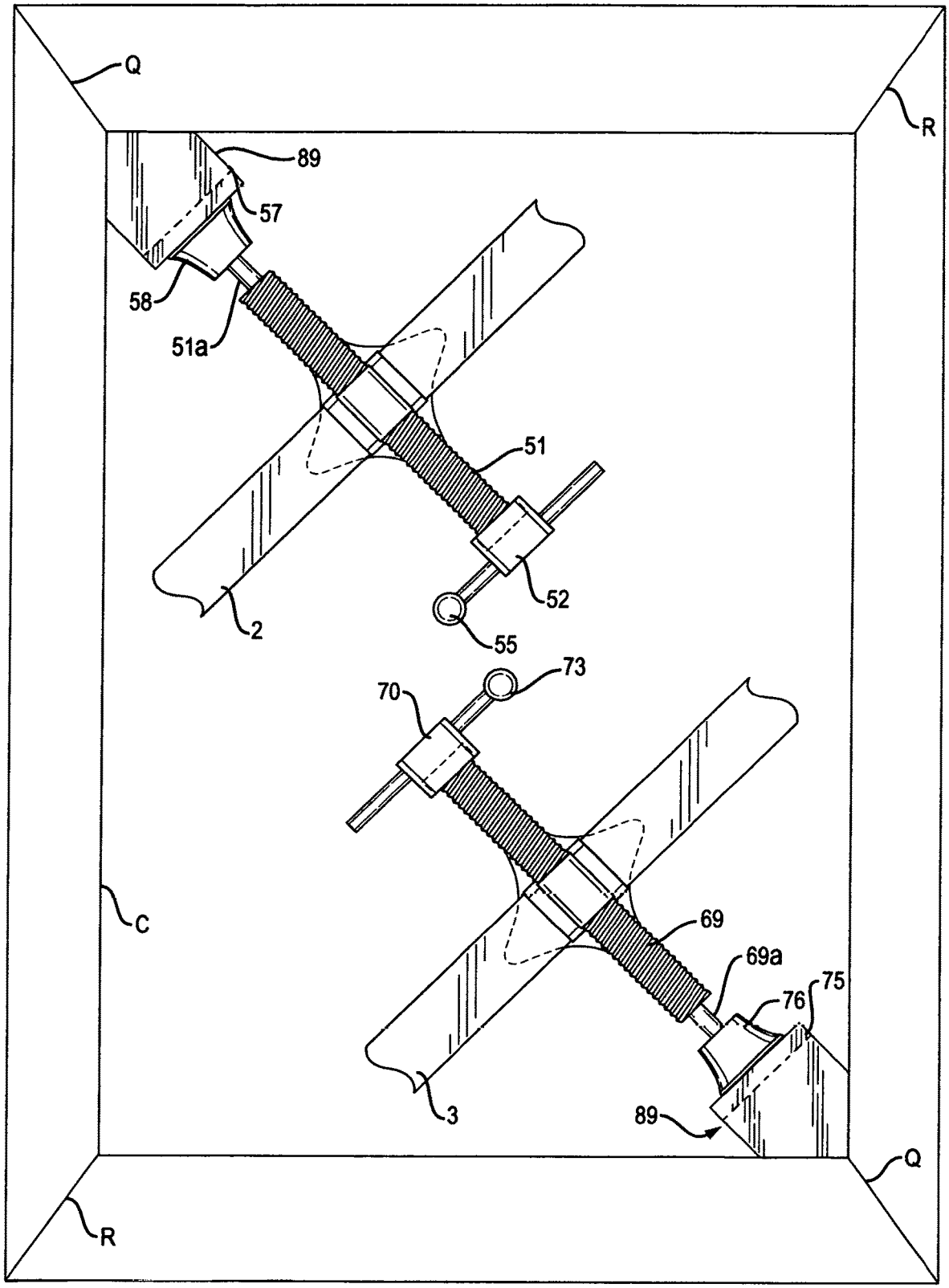
FIG. 14 illustrates spreading work being performed on a window frame.

At this juncture, it should be noted that one of the unique features of the invention is that component 4 can be removably held about either crossbar 2 or crossbar 3. Component 5 can also be so held about crossbar 3 or crossbar 2. Similarly component 6 and component 7 can likewise be so held about either crossbar 2 or crossbar 3. None of components 4, 5, 6 and 7 are permanently fixed in place. Another unique feature of the invention is the capability that it has for serving either as a woodworking clamping device or as a woodworking spreading device. For clamping, shoeholder elements 57 and 75 are held by components 6 and 7 respectively, in the manner previously described, so that the bottomsides of each then face one another. On the other hand, mere removal of component 6 from crossbar 2 and replacement of component 6 about crossbar 2 after rotation of component 6 vertically through an angle of 180° and concomitant removal of component 7 from crossbar 3 and replacement of component 7 about crossbar 3 after rotation of component 7 vertically through an angle of 180° such that then the respective bottomsides of shoeholder elements 57 and 75 are each then facing away from one another, serves to render the invention as a spreading device as seen in FIG. 14. Yet, another unique feature of the invention is the capability that it has for providing a relatively limitlessly sized work field for either clamping or spreading. Current clamping devices and also current spreading devices are limited in respective of work field space in either an X plane or a Y plane. On the other hand, the present invention is not limited at all, relatively stated; as respects work field space capacity in either an X plane or a Y plane. The only limitations on such workspace are those brought about by any ultimate length of vertically inclined support bar 1 and ultimately, also any readily adjustable lengths of crossbars 2 and 3 respectively. That such is the case is due to the unique character of bar holder components 4 and 5 and workholder components 6 and 7. Components 4 and 5 have first and second vertically inclined bar holding sleeving elements 18 and 35 respectively that serve to facilitate adjustable holding of components 4 and 5 anywhere up and down the length of vertically inclined support bar 1. Also, components 4 and 5 have first and second horizontally inclined sleeving elements 8 and 25 respectively that serve to facilitate adjustable holding of components 4 and 5 anywhere back or forth along the lengths of crossbars 2 and 3 respectively. Similarly, components 6 and 7 have third sleeving element 42 and fourth sleeving element 60 respectively that serve to facilitate adjustable holding of components 6 and 7 anywhere back or forth along the length of crossbars 2 and 3 respectively on the same side of support bar 1.

All of the foregoing is accomplished as follows: Component 4 is adjusted fast to support bar 1 to a desired position thereupon by way of manually rotating turning handle unit 23 clockwise and accordingly bolt 22 into nut 21 and, in turn through hole 19 within sleeving element 18 sufficiently enough so as to tightly compress support bar 1 fast against the inner walling of the side of sleeving element 18 being directly adjacent anchoring plate 15. A facility for this protocol for adjustment is appreciated initially with reference to FIG. 4B. Also, component 4 is adjusted fast to crossbar 2 to a desired position thereupon by way of manually rotating turning handle unit 13 clockwise and accordingly bolt 12 into nut 11 and, in turn, through hole 9 within sleeving element 8 sufficiently enough so as to tightly compress crossbar 2 fast against the inner walling of the side of sleeving element 18 directly adjacent anchoring plate 15. A facility for this protocol for adjustment is appreciated with reference to FIG. 4A. Anchoring plate 15 via welds 16 and 17 serves to ensure anchored permanency without slippage of the perpendicular positioning of sleeving elements 8 and 18 relative to one another.

Component 5 is adjusted first to support bar 1 to a desired position thereupon by way of manually rotating turning handle unit 40 clockwise and accordingly bolt 39 into nut 38 and, in turn through hole 36 within sleeving element 35 sufficiently enough so as to tightly compress support bar 1 fast against the inner walling of the side of sleeving element 35 directly adjacent anchoring plate 32. A facility for this protocol for adjustment is appreciated with reference to FIG. 5B. Also, component 5 is adjusted fast to crossbar 3 to a desired position thereupon by way of manually rotating turning handle unit 30 clockwise and accordingly bolt 29 into nut 28 and, in turn through hole 26 within sleeving element 25 sufficiently enough so as to tightly compress crossbar 3 fast against the inner walling of the side of sleeving element 25 directly adjacent anchoring plate 32. A facility for this protocol for adjustment is appreciated with reference to FIG. 5A. Anchoring plate 32 via welds 33 and 34 serves to ensure anchored permanency without slippage, of the perpendicular positioning of sleeving elements 25 and 35 relative to one another.

Component 4 and, in turn, crossbar 2, as well, are adjustable positionally up or down support bar 1 simply by rotating turning handle unit 23 counterclockwise so as to thereby loosen support bar 1 within sleeving element 18, then moving component 4 up or down support bar 1 to a desired position thereupon and thence once again rotating turning handle unit 23 once again clockwise so as to thereby again effectuate secure tightening. Similarly crossbar 2 can be repositioned horizontally within sleeving component 8 merely by rotating turning handle unit 13 counterclockwise so as to thereby loosen crossbar 2 within sleeving element 8, then moving crossbar 2 back or forth within sleeving element 8 to a desired position therein and then once again rotating turning handle unit 13 once again clockwise so as to thereby again effectuate secure tightening.

Component 5 and, in turn, crossbar 3, as well, are adjustable positionally up or down support bar 1 simply by rotating turning handle 40 counterclockwise so as to thereby loosen support bar 1 within sleeving element 35 then moving component 5 up or down support bar 1 to a desired position thereupon and then once again rotating turning handle unit 40 once again clockwise so as to thereby again effectuate secure tightening. Similarly, crossbar 3 can be repositioned horizontally within sleeving element 25 merely by rotating turning handle unit 30 counterclockwise so as to thereby loosen crossbar 3 within sleeving element 25 then moving crossbar 3 back or forth within sleeving element 25 to a desired position therein and thence once again rotating turning handle unit 30 once again clockwise so as to thereby again effectuate secure tightening.

Component 6 is adjustable fast to crossbar 2 by way of manually rotating turning handle unit 47 clockwise, and, in turn, also bolt 46 into nut 45 and through hole 43 within sleeving element 42. Crossbar 2 is thereby compressed tightly into the back walling of sleeving element 42. A desire to cause positioning of component 6 to a different location about crossbar 2 is satisfied by merely rotating handle unit 47 counterclockwise thereby loosening crossbar 2 within sleeving element 42. Component 6 is then moved to a different location about crossbar 2 and turning handle unit 47 is again rotated clockwise until a requisite tightening is again achieved. Component 7 is adjustable fast to crossbar 3 by way of manually rotating turning handle unit 65 clockwise, and, in turn, also bolt 64 into nut 63 and through hole 61 within sleeving element 60. Crossbar 3 is thereby compressed tightly into the back walling of sleeving element 60. A desire to cause positioning of component 7 to a different location about crossbar 3 is satisfied by merely rotating handle unit 65 counterclockwise thereby loosening crossbar 3 within sleeving element 60. Component 7 is then moved to a different location about crossbar 3 and turning handle unit 65 is again rotated clockwise until a requisite tightening is again achieved. Once components 4, 5, 6 and 7 are positioned tightly into place with reference to support bar 1 and crossbars 2 and 3, the invention is then properly postured so as to accept work, either to be clamped or spreaded as the case may be, when such work is held ultimately by components 6 and 7 in the manner such as will now be described.

As was earlier pointed out, if clamping work is sought to be accomplished, then components 6 and 7 will be tightened to and positioned about crossbars 2 and 3 in such a manner that shoeholder elements 57 and 75 will ultimately be facing towards one another. As respects clamping, turning cap unit 52 of component 6 when rod 55 is turned clockwise will cause bolt 51, held within bolt holder 49, to be rotated vertically downward. Similarly, turning cap unit 70 of component 7 when rod 73 is turned clockwise will cause bolt 69, held within bolt holder 67, to be rotated vertically upward. In this manner, shoeholder elements 57 and 75 held respectively by the respective ball shaped end portions 56 and 74 of bolts 51 and 69 will positionally approximate one another. In turn, two shoe elements held respectively, one by shoeholder element 57 and one by shoeholder element 75 will also approximate one another, and, in turn also approximate each piece of wood to be ultimately held for clamping as between the base member portions of the shoe elements being so respectively held, one each by each of shoeholder elements 57 and 75. Any clamping of any two pieces of wood together is preceded by first applying a glue material P, as shown, for example in FIG. 18, to one side of one of the two pieces of wood. FIGS. 15-22 serve to illustrate various clamping modalities such as can be accomplished via the clockwise turning protocols just described. Such protocols, so resorted to, result in a large amount of pressure being applied to the sides of the pieces of wood sought to be clamped together, to wit, to the portions of the sides thereof such as would be facing the base member portions of the particular shoe elements being held by the shoeholder elements 57 and 75. Turning cap units 52 and 70 in conjunction with rods 55 and 73 respectively serve to generate much greater pressure as between the base member portions of the shoe elements being utilized than would be the case with resort to turning handle units instead and in lieu of such turning cap units in conjunction with the rods. On the other hand, if spreading work is sought to be accomplished, then components 6 and 7 will be tightened and positioned about crossbars 2 and 3 in such a manner that shoeholder elements 57 and 75 will ultimately be facing away from one another. FIG. 14 illustrates a spreading modality that can be accomplished via the clockwise turning protocols just previously described once components 6 and 7 would have each been first vertically rotated through angles of 180°. Similarly, turning cap units 52 and 70 in conjunction with rods 55 and 73, as previously noted, serve to provide notably more pressure at base member portions being applied to work to be so spread.

Figure 15:
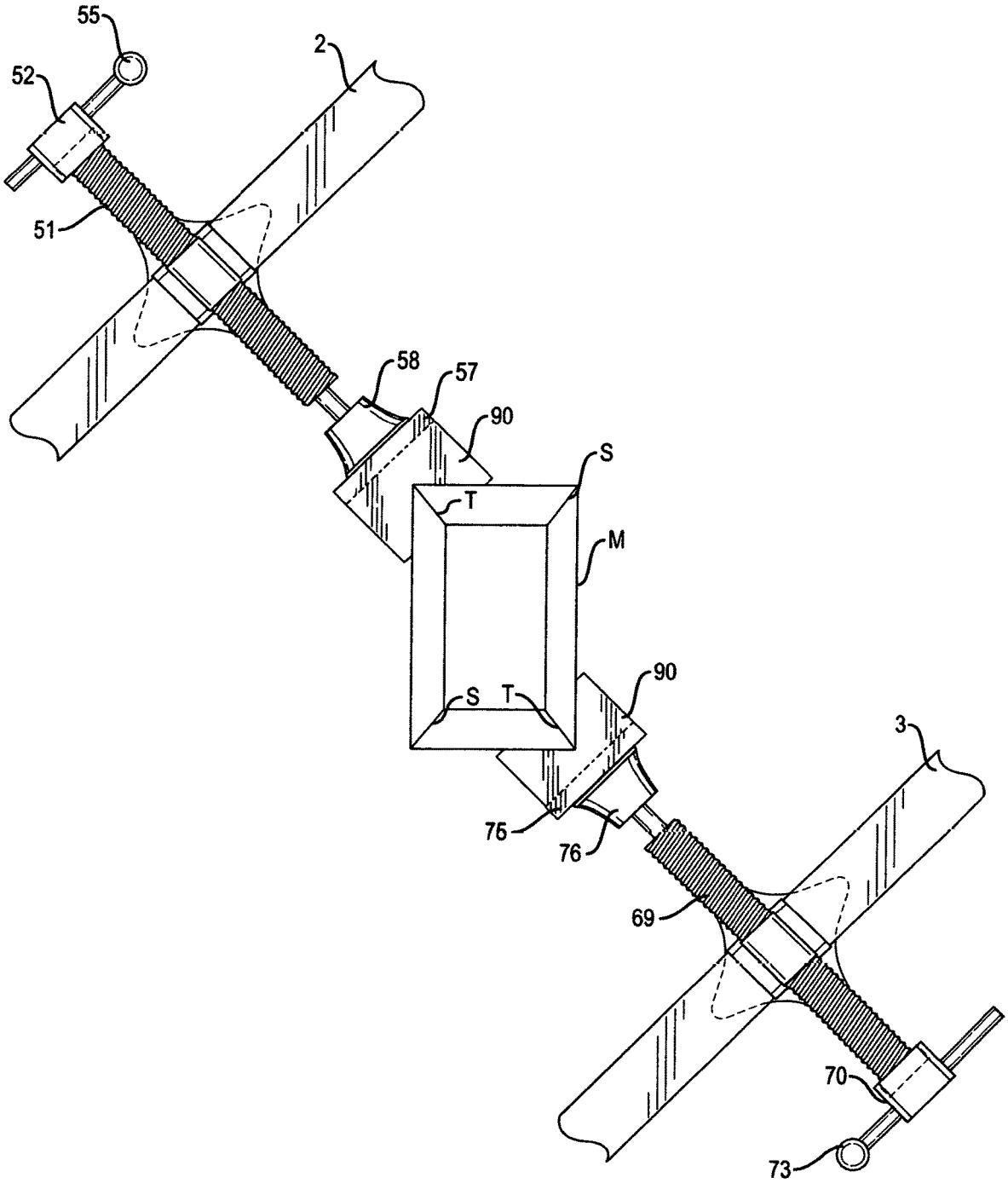
FIG. 15 illustrates equalization of diagonals of a wooden frame unit being clamped together at the corners thereof.
Figure 16:
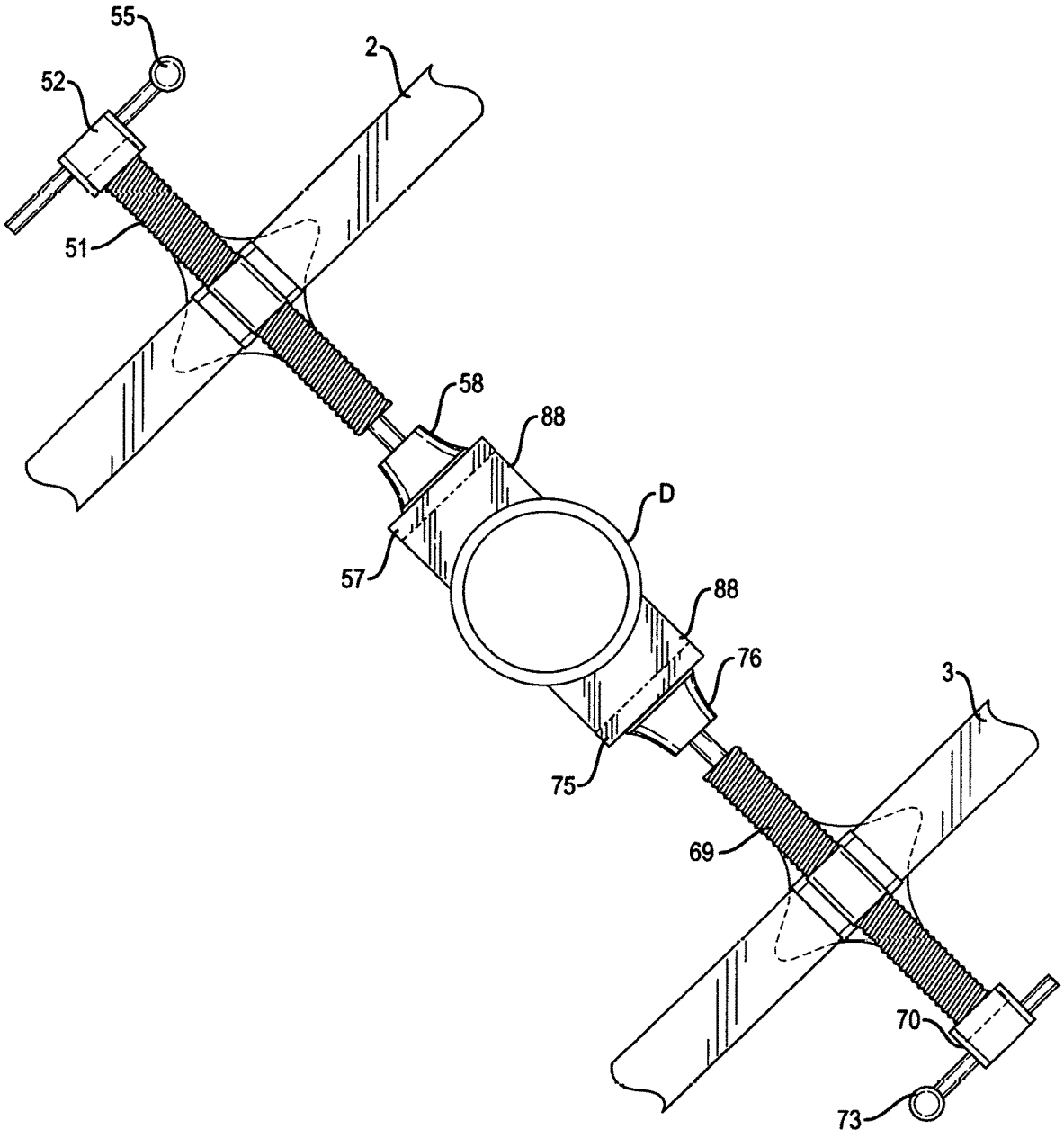
FIG. 16 illustrates the precise cutting of a piece of pipe.
Figure 17:
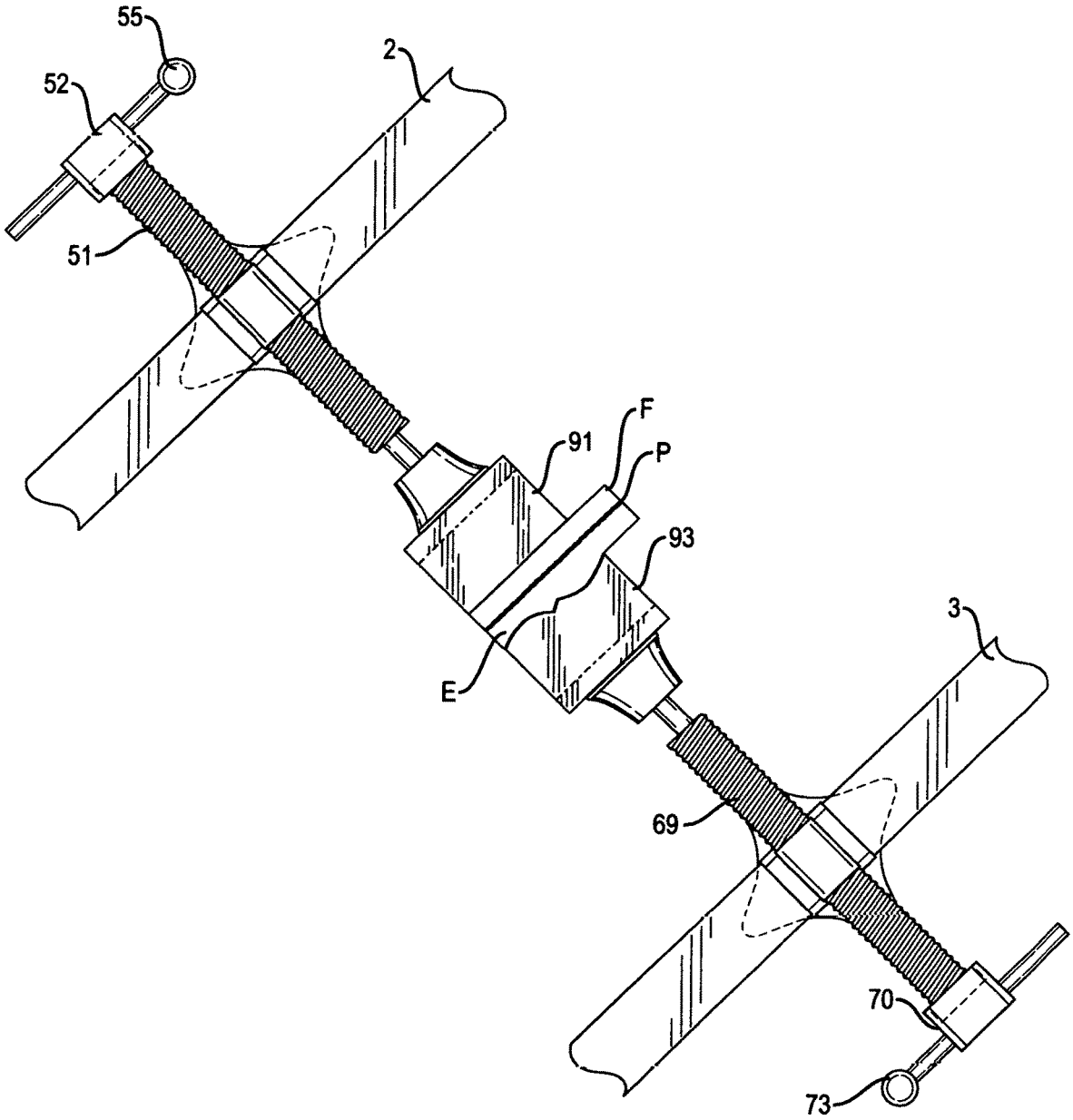
FIG. 17 illustrates the clamping of a piece of wood molding to a flat piece of wood backing.
Figure 18:
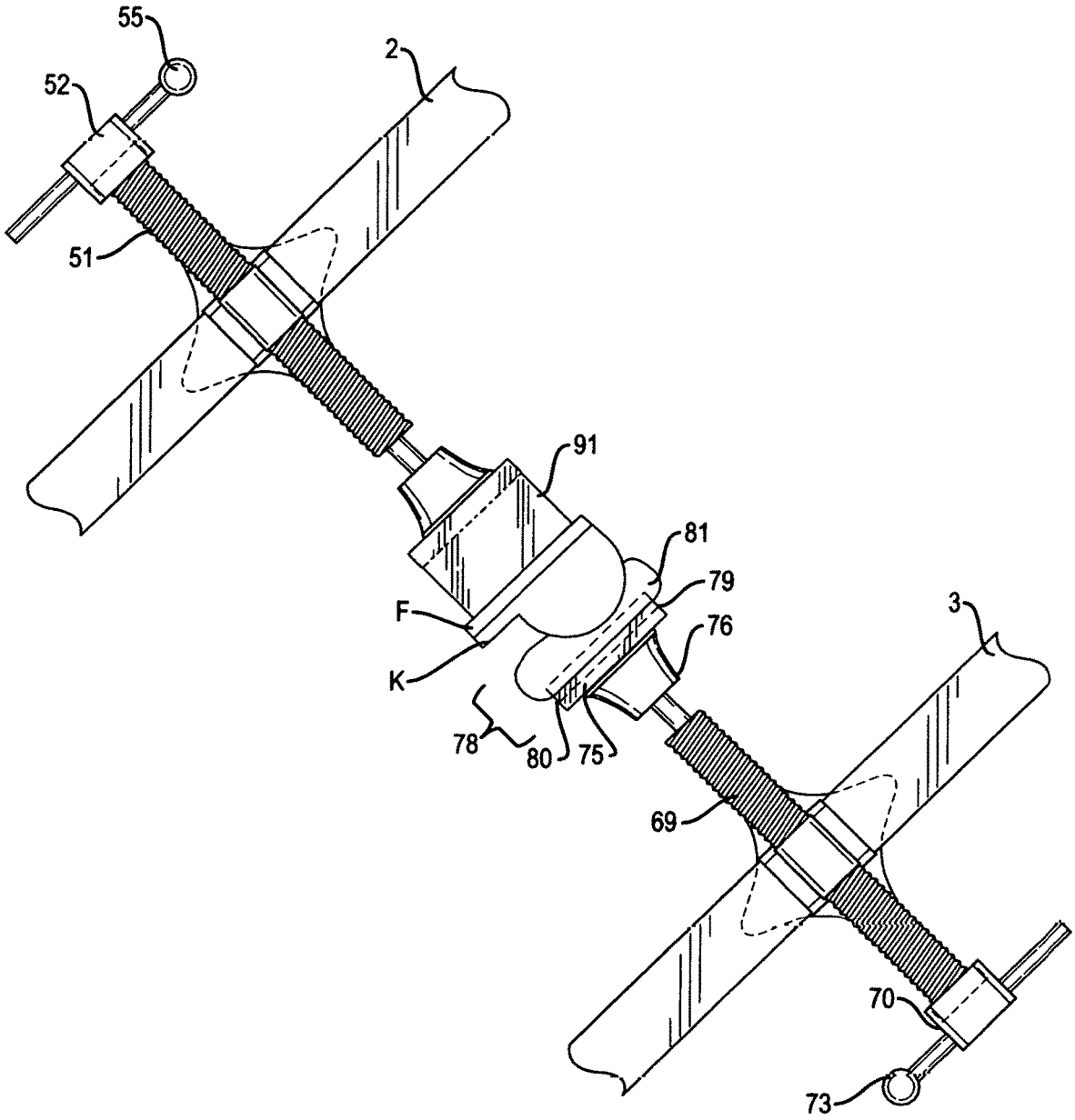
FIG. 18 illustrates the clamping of an oddly shaped piece of wood molding to a flat piece of wood.
Figure 19:
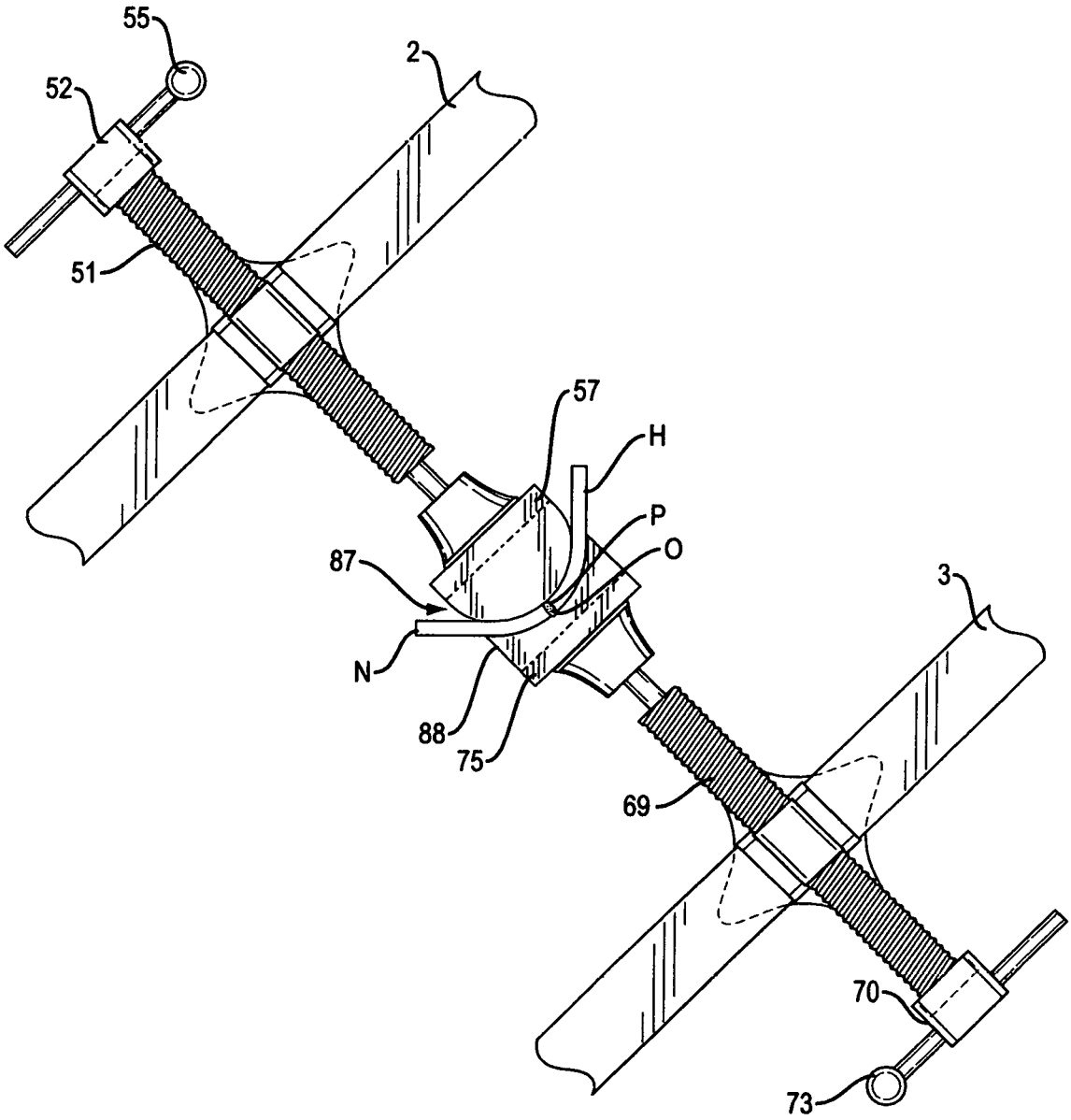
FIG. 19 illustrates curvaceous clamping of two previously moistened pieces of wood.
Figure 20:
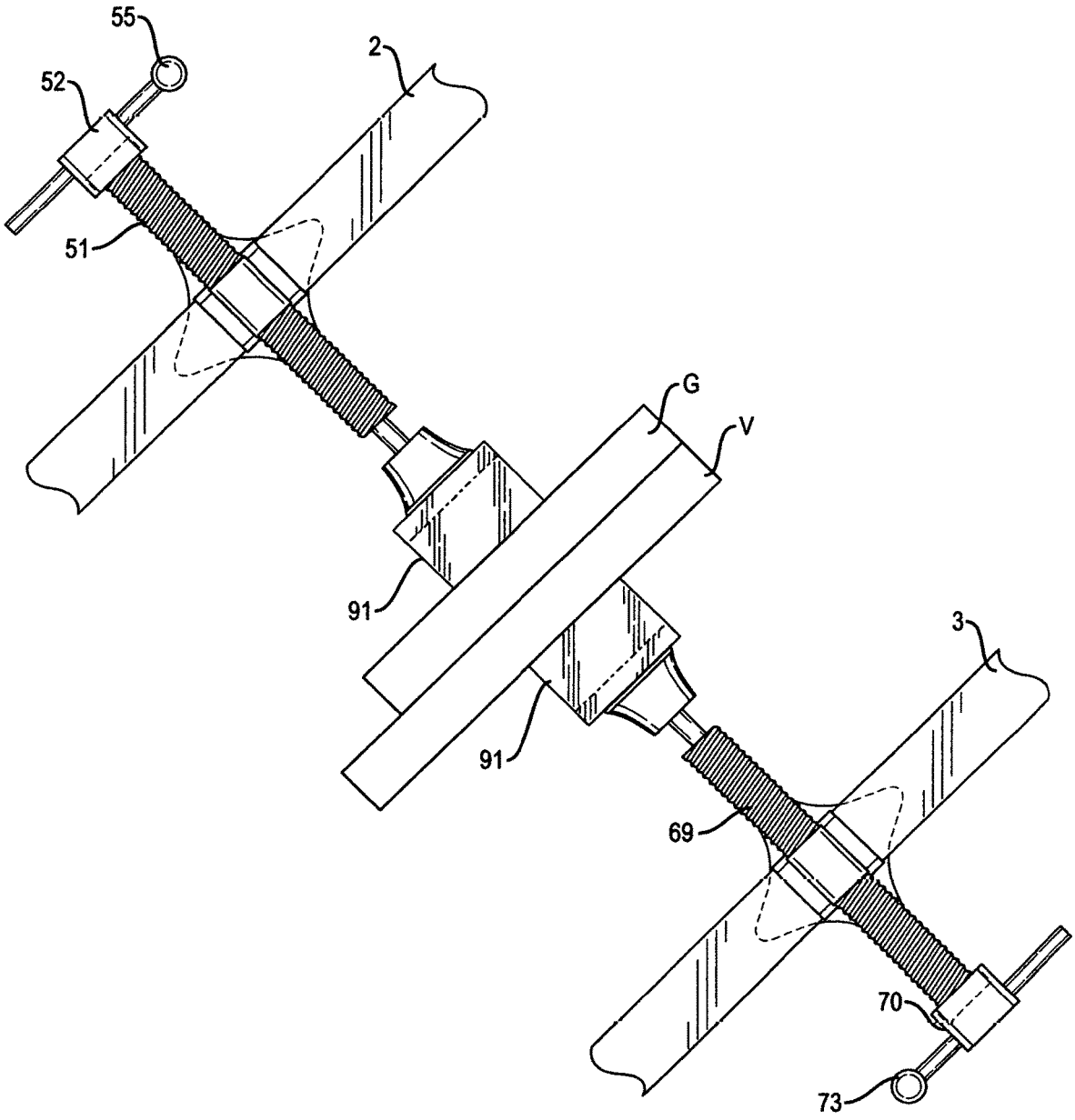
FIG. 20 illustrates the clamping together of two flat sided pieces of wood.
Figure 21:
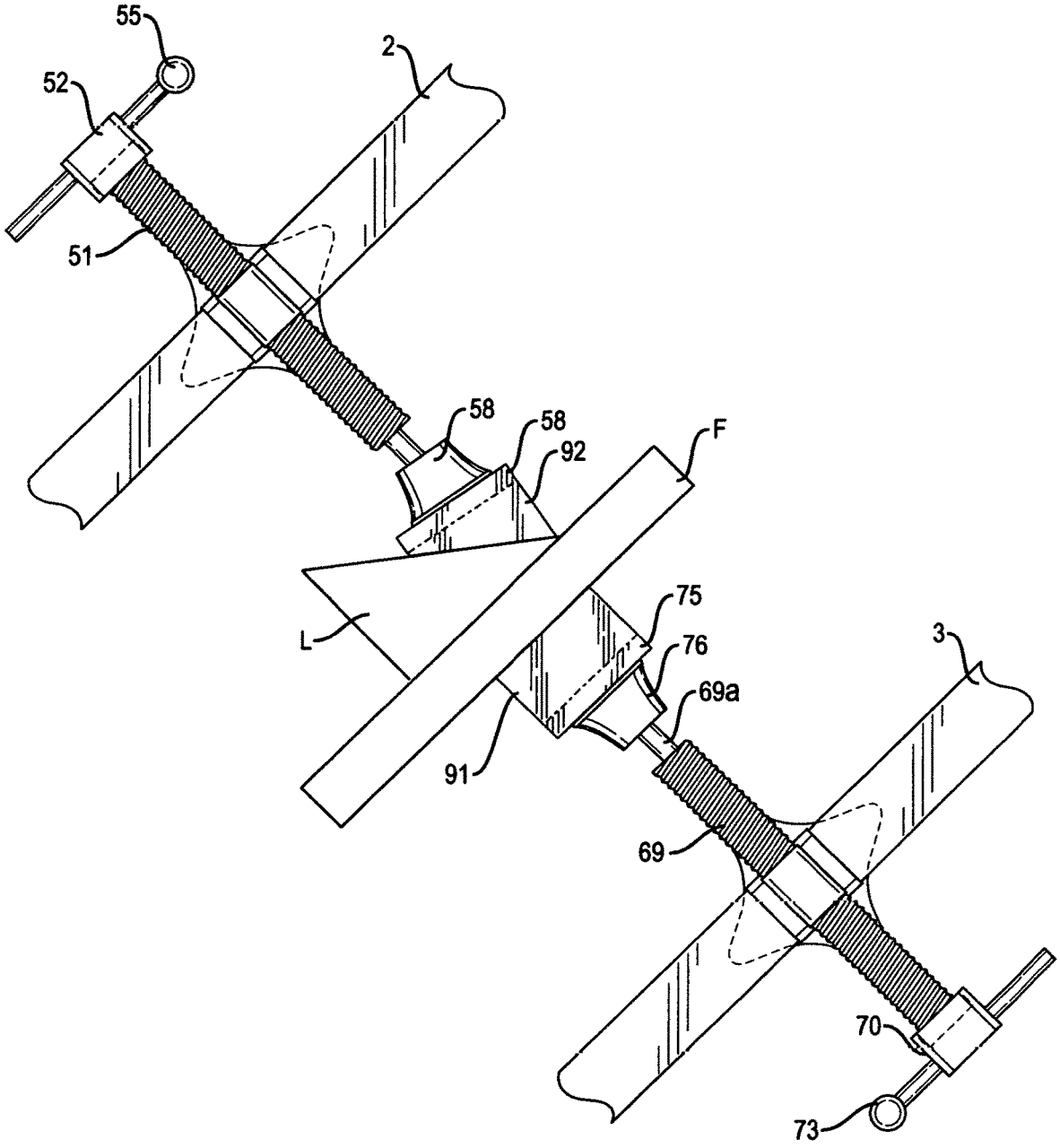
FIG. 21 illustrates the clamping of a triangularly shaped piece of wood to a flat piece of wood.
Figure 22:
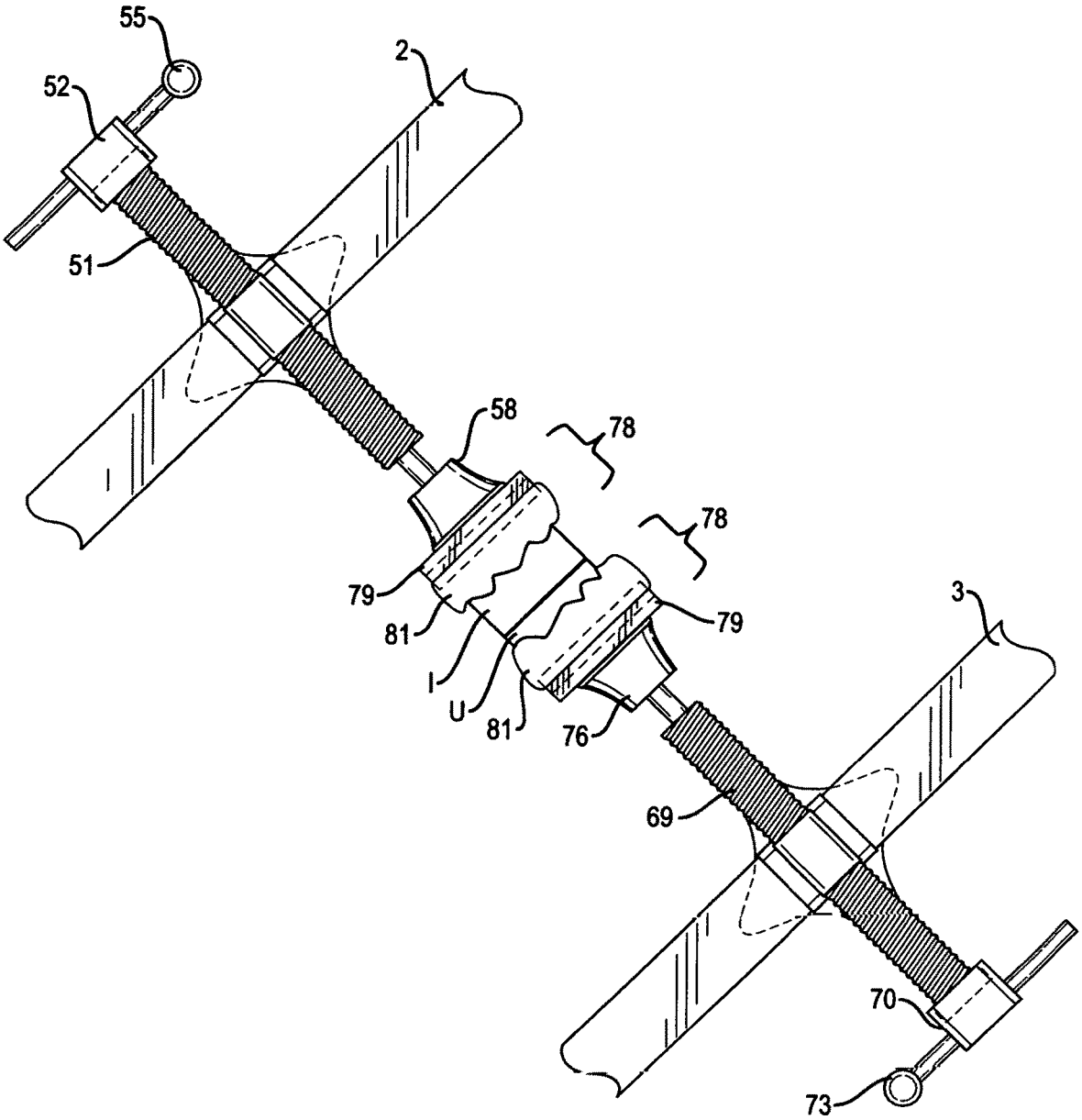
FIG. 22 illustrates the clamping together of two wavy irregularly shaped pieces of wood.

At this juncture, efforts will be devoted to illustrating some of the many various applications to the performance of work that can be accomplished with resort to utilization of variants of the invention. To begin with, one of the most important doings in need of being undertaken by a woodworker is an application that involves the precise equalization of the two diagonals, as it were, of any particular rectangularly shaped piece of wood such as, for example, a door or perhaps a window frame. Such equalization is very important for purposes of ensuring that, for instance, e.g., a window frame will fit properly within the spacing meant to receive it. FIG. 14 depicts a spreading undertaking involving a picture frame unit C. Two shoe elements 89 held by respective shoeholder elements 57 and 75 directed oppositely from one another serve to apply pressure to opposite corners of unit C in an effort to equalize the two diagonals Q and R of unit C for purposes of receipt of a portrait to be fitted within the lumen of unit C. FIG. 15, on the other hand, demonstrates equalization of diagonals S and T with respect to a window frame M by way of clamping inwardly as opposed to spreading outwardly. In FIG. 15, shoeholders 57 and 75 holding shoe elements 90 cause pressure to be brought to bear upon opposite corners of frame M. so as to bring about equalization of diagonals S and T thereof for purposes of ensuring a ready fit of frame M into a window space meant to receive it. FIG. 16 depicts yet another viable application of the invention, namely the precise cutting of a pipe D. Shoeholders 57 and 75 hold shoe elements 88 firmly and tightly about the exterior walling of pipe D thereby enabling one to saw off a portion of pipe D precisely at one end of pipe D immediately exterior to where pipe D is so held by shoe elements 88. FIG. 17 enables appreciation of how the backside of a piece of molding E can be clamped to the frontside of a first elongated flat piece of wood F once glue P has first been applied to either the back side of molding E or the front side of piece F. Shoe elements 91 and 93 held respectively by shoeholders 57 and 75 serve to convey pressure to piece F and molding E, to wit, pressure resulting from turning rod units 55 and 73 respectively clockwise so as to cause holding bolt units 51 and 69 threadably held within bolt holder units 49 and 67 respectively, to correspondingly approximate one another. This resultant creation and transference inwardly of pressure also provides the means by which the doings, as depicted in FIGS. 14, 15 and 16, are accomplished as well, except that as respects FIG. 14, pressure is so created and transferred outwardly for purpose of bringing about spreading. FIG. 18 depicts such clamping in an instance where it is desired to conjoin an irregularly shaped piece of wood K at the backside thereof to the frontside of a flat piece of wood F once some glue P, for purposes of holding pieces K and F together, would have been first applied to the backside of piece K or the front side of piece F. Shoeholder 57 holding shoe element 91 and shoeholder 75 holding tripartite shoe element 78 combine to compress pieces K and F together in the same manner as described just above in respect of the matter of the creation and transference of pressure. It's worth pointing out, at this juncture, that clamping devices presently in vogue cannot function for purposes of efficiently clamping together an irregularly shaped piece of wood K and a flat piece F. This is because none of them have the variance at a given clamping jaw site that is provided by resort to a sandbag shoe element 78, the sandbag member portion 81 of which contains sand J that can pliably facilitate shaping under pressure about the front side of any piece of wood K. This is yet another and very important reason in support of why it is that this invention is so vastly useful and truly unique. FIG. 19 illustrates yet another highly viable application of the invention. The invention also facilitates the bending of two pieces of water soaked wood H and N so as to then provide each piece H and N with equivalent radii of curvature near the ends of each at a point O. Each is then amenable to being glued together via glue material P at the ends of each located respectively at and adjacent point O. This outcome is accomplished by way of the creation and transference of pressure in the manner as previously described but now with resort to its shoe elements 87 and 88 as shown in FIG. 19. FIG. 20 illustrates garden variety clamping of two flat pieces of wood, a first elongated flat piece of wood G and a second elongated flat piece of wood V in the manner previously described, but, with resort to each of two shoe elements 91. FIG. 21 serves to show how, with the invention and with resort to its shoe elements 91 and 92, it is possible to clamp a triangularly shaped piece of wood L to a flat piece of wood F. FIG. 21 also serves to highlight the importance of the rotatable holding of a shoeholder element 57 about a ball shaped end portion 56 or the rotatable holding of a shoeholder element 75 about a ball shaped end portion 74. This application is made possible only by virtue of the fact of such rotatable holding as being, yet another notably unique feature of the invention. Finally, FIG. 22 exhibits the clamping of each of two wavy irregular pieces of wood I and U to one another with resort to each of two sandbag shoe elements 78, one being held by shoeholder element 57 and the other being held by shoeholder element 75.

In conclusion, with reference to the above described applications, it is respectfully submitted that the invention is not merely new, useful and unique, but is, rather instead, veritably revolutionary in the art where woodworkers' clamping or spreading devices are concerned.

What is claimed is:

1. A multipurpose woodworker's clamping and spreading apparatus, comprising:

a. a vertically inclined metallic support bar;

b. a first horizontally inclined metallic crossbar;

c. a second horizontally inclined metallic crossbar;

d. a first two-way adjustable bar holder component;

e. a second two-way adjustable bar holder component;

f. a first adjustable workholder component;

g. a second adjustable workholder component;

h. a first horizontally inclined bar holding metallic sleeving element of said first bar holder component for slideable receipt of said first horizontally inclined crossbar;

i. a hole in said first horizontally inclined bar holding sleeving element;

j. a first weld;

k. a first internally threaded nut welded via said first weld to a first side of said first horizontally inclined bar holding sleeving element about said hole in said first horizontally inclined bar holding sleeving element;

l. a first externally threaded bolt receivable by said first internally threaded nut and further receivable by said hole in said first horizontally inclined bar holding sleeving element;

m. a first metallic turning handle unit;

n. a centrally positioned closed hole in said first handle unit for press fitted receipt of a head portion of said first externally threaded bolt;

o. a first metallic anchoring plate;

p. a second weld for welding a second side of said first horizontally inclined bar holding sleeving element to a first side of said first anchoring plate;

q. a third weld;

r. a first vertically inclined bar holding metallic sleeving element of said first bar holder component for slideable receipt of said support bar, and welded at a first side thereof by said third weld to a second side of said first anchoring plate;

s. a hole in said first vertically inclined bar holding sleeving element;

t. a fourth weld;

u. a second internally threaded nut welded via said fourth weld to a second side of said first vertically inclined bar holding sleeving element, and about said hole in said first vertically inclined bar holding sleeving element;

v. a second externally threaded bolt receivable by said second internally threaded nut and said hole in said first vertically inclined bar holding sleeving element;

w. a second metallic turning handle unit;

x. a centrally positioned closed hole in said second turning handle unit for press fitted receipt of a head portion of said second externally threaded bolt;

y. a second horizontally inclined bar holding metallic sleeving element of said second bar holder component for slideable receipt of said second horizontally inclined crossbar;

z. a hole in said second horizontally inclined bar holding sleeving element;

aa. a fifth weld;

bb. a third internally threaded nut welded via said fifth weld to a first side of said second horizontally inclined bar holding sleeving element about said hole in said second horizontally inclined bar holding sleeving element;

cc. a third externally threaded bolt receivable by said third internally threaded nut further receivable by said hole in said second horizontally inclined bar holding sleeving element;

dd. a third metallic turning handle unit;

ee. a centrally positioned closed hole in said third handle unit for press fitted receipt of a head portion of said third externally threaded bolt;

ff. a second metallic anchoring plate;

gg. a sixth weld for welding a second side of said second horizontally inclined bar holding sleeving element to a first side of said second anchoring plate;

hh. a seventh weld;

ii. a second vertically inclined bar holding metallic sleeving element of said second bar holder component for slideable receipt of said support bar, and welded at a first side thereof via said seventh weld to a second side of said second anchoring plate;

jj. a hole in said second vertically inclined bar holding sleeving element;

kk. an eighth weld;

ll. a fourth internally threaded nut welded via said eighth weld to a second side of said second vertically inclined bar holding sleeving element about said hole in said second vertically inclined bar holding sleeving element;

mm. a fourth externally threaded bolt receivable by said fourth nut and further receivable by said hole in said second vertically inclined bar holding sleeving element;

nn. a fourth metallic turning handle unit;

oo. a centrally positioned closed hole in said fourth turning handle unit for press fitted receipt of a head portion of said fourth externally threaded bolt;

pp. a third horizontally inclined bar holding sleeving element for slideable receipt of said first crossbar, and being a part of said first adjustable workholder component;

qq. a hole in said third horizonally inclined bar holding sleeving element;

rr. a ninth weld;

ss. a fifth internally threaded nut welded via said ninth weld to a first side of said third horizontally inclined bar holding sleeving element about said hole;

tt. a fifth externally threaded bolt receivable by said fifth internally threaded nut;

uu. a fifth metallic turning handle unit;

vv. a centrally positioned closed hole in said fifth turning handle unit for press fitted receipt of a head of said fifth externally threaded bolt;

ww. a first elongated internally threaded bolt holder unit;

xx. a tenth weld for welding said first elongated internally threaded bolt holder unit to a second side of said third horizontally inclined bar holding sleeving element;

yy. a first elongated, vertically inclined holding bolt with metallic first base rod extension member portion thereof and with said first holding bolt being receivable by said first elongated internally threaded bolt holder unit;

zz. a first metallic turning cap unit;

aaa. a closed hole in said first turning cap unit for press fitted receipt of a head portion of said first elongated, vertically inclined holding bolt;

bbb. a first superior horizontally inclined through hole in said first turning cap unit;

ccc. a first metallic turning rod slideably insertable within said first superior through hole;

ddd. a metallic ball shaped end portion of said first base rod extension member portion;

eee. a first solid metallic shoeholder element;

fff. a first end portion hollow, metallic housing unit for loosely and rotatably holding said ball shaped end portion and being soldered at a base brim portion thereof to a topside of said first shoeholder element;

ggg. a first superiorly positioned hole in said first housing unit and ultimately having a greatest crosswise breadth being less than a diameter of said ball shaped end portion of said first base rod extension member;

hhh. a fourth horizontally inclined bar holding metallic sleeving element for slideable receipt of said second crossbar, and being a part of said second adjustable workholder component;

iii. a round hole in said fourth horizontally inclined bar holding sleeving element;

jjj. an eleventh weld;

kkk. a sixth internally threaded nut welded via said eleventh weld to a first side of said fourth horizontally inclined bar holding sleeving element about said round hole;

lll. a sixth externally threaded bolt receivable by said sixth internally threaded nut;

mmm. a sixth metallic turning handle unit;

nnn. a centrally positioned closed hole in said sixth turning handle unit for press fitted receipt of a head portion of said sixth externally threaded bolt;

ooo. a second elongated internally threaded bolt holder unit;

ppp. a twelfth weld for welding said second elongated internally threaded bolt holder unit to a second side of said fourth horizontally inclined bar holding sleeving element;

qqq. a second elongated, vertically inclined holding bolt with metallic base rod extension member portion thereof and with said second holding bolt being receivable by said second elongated internally threaded bolt holder unit;

rrr. a second metallic turning cap unit;

sss. a closed hole in said second turning cap unit for receipt of a head portion of said second elongated, vertically inclined holding bolt;

ttt. a second superior horizontally inclined through hole in said second turning cap unit;

uuu. a second metallic turning rod slideably insertable within said second superior through hole;

vvv. a metallic ball shaped end portion of said second base rod extension member portion;

www. a second solid metallic shoeholder element;

xxx. a second end portion hollow, metallic housing unit for loosely and rotatably holding said ball shaped end portion of said second base rod extension member and being soldered with a solder material at a base brim portion thereof to a topside of said second shoeholder element;

yyy. a superiorly positioned hole in said second housing unit and ultimately having a greatest crosswise breadth being less than a diameter of said ball shaped end portion of said second base rod extension member;

zzz. a first solid shoe element;

aaaa. a sleeving member portion of said first shoe element for slideable receipt of said first shoeholder component;

bbbb. a variably shaped base member portion of said first shoe element;

cccc. a second solid shoe element;

dddd. a sleeving member portion of said second shoe element for slideable receipt of said second shoeholder element, and;

eeee. a variably shaped base member portion of said second shoe element.

2. The multipurpose woodworker's clamping and spreading apparatus of claim 1, whereby, said base member portion of said first shoe element is convexly rounded in shape.

3. The multipurpose woodworker's clamping and spreading apparatus of claim 1, whereby, said base member portion of said first shoe element is concavely rounded in shape.

4. The multipurpose woodworker's clamping and spreading apparatus of claim 1, whereby, said base member portion of said first shoe element is convexly triangular in shape.

5. The multipurpose woodworker's clamping and spreading apparatus of claim 1, whereby, said base member portion of said first shoe element is concavely triangular in shape with anterior and posterior outer edging.

6. The multipurpose woodworker's clamping and spreading apparatus of claim 1, whereby, said base member portion of said first shoe element is flat sided in shape.

7. The multipurpose woodworker's clamping and spreading apparatus of claim 1, whereby, said base member portion of said first shoe element is right triangular in shape.

8. The multipurpose woodworker's clamping and spreading apparatus of claim 1, whereby, said base member portion of said first shoe element is wavy irregular in shape.

9. The multipurpose woodworker's clamping and spreading apparatus of claim 1, whereby, said base member portion of said second shoe element is convexly rounded in shape.

10. The multipurpose woodworker's clamping and spreading apparatus of claim 1, whereby, said base member portion of said second shoe element is concavely rounded in shape.

11. The multipurpose woodworker's clamping and spreading apparatus of claim 1, whereby, said base member portion of said second shoe element is convexly triangular in shape.

12. The multipurpose woodworker's clamping and spreading apparatus of claim 1, whereby, said base member portion of said second shoe element is concavely triangular in shape with anterior and posterior outer edging.

13. The multipurpose woodworker's clamping and spreading apparatus of claim 1, whereby said base member portion of said second shoe element is flat sided in shape.

14. The multipurpose woodworker's clamping and spreading apparatus of claim 1, whereby said base member portion of said second shoe element is right triangular in shape.

15. The multipurpose woodworker's clamping and spreading apparatus of claim 1, whereby said base member portion of said second shoe element is wavy irregular in shape.

16. A multipurpose woodworker's clamping and spreading apparatus, comprising:

a. a vertically inclined metallic support bar;

b. a first horizontally inclined metallic crossbar;

c. a second horizontally inclined metallic crossbar;

d. a first two-way adjustable bar holder component;

e. a second two-way adjustable bar holder component;

f. a first adjustable workholder component;

g. a second adjustable workholder component;

h. a first horizontally inclined bar holding metallic sleeving element of said first bar holder component for slideable receipt of said first horizontally inclined crossbar;

i. a hole in said first horizontally inclined bar holding sleeving element;

j. a first weld;

k. a first internally threaded nut welded via said first weld to a first side of said first horizontally inclined bar holding sleeving element about said hole in said first horizontally inclined bar holding sleeving element;

l. a first externally threaded bolt receivable by said first internally threaded nut and further receivable by said hole in said first horizontally inclined bar holding sleeving element;

m. a first metallic turning handle unit;

n. a centrally positioned closed hole in said first handle unit for press fitted receipt of a head portion of said first externally threaded bolt;

o. a first metallic anchoring plate;

p. a second weld for welding a second side of said first horizontally inclined bar holding sleeving element to a first side of said first anchoring plate;

q. a third weld;

r. a first vertically inclined bar holding metallic sleeving element of said first bar holder component for slideable receipt of said support bar, and welded at a first side thereof by said third weld to a second side of said first anchoring plate;

s. a hole in said first vertically inclined bar holding sleeving element;
t. a fourth weld;
u. a second internally threaded nut welded via said fourth weld to a second side of said first vertically inclined bar holding sleeving element, and about said hole in said first vertically inclined bar holding sleeving element;
v. a second externally threaded bolt receivable by said second internally threaded nut and said hole in said first vertically inclined bar holding sleeving element;
w. a second metallic turning handle unit;
x. a centrally positioned closed hole in said second turning handle unit for press fitted receipt of a head portion of said second externally threaded bolt;
y. a second horizontally inclined bar holding metallic sleeving element of said second bar holder component for slideable receipt of said second horizontally inclined crossbar;
z. a hole in said second horizontally inclined bar holding sleeving element;
aa. a fifth weld;
bb. a third internally threaded nut welded via said fifth weld to a first side of said second horizontally inclined bar holding sleeving element about said hole in said second horizontally inclined bar holding sleeving element;
cc. a third externally threaded bolt receivable by said third internally threaded nut further receivable by said hole in said second horizontally inclined bar holding sleeving element;
dd. a third metallic turning handle unit;
ee. a centrally positioned closed hole in said third handle unit for press fitted receipt of a head portion of said third externally threaded bolt;
ff. a second metallic anchoring plate;
gg. a sixth weld for welding a second side of said second horizontally inclined bar holding sleeving element to a first side of said second anchoring plate;
hh. a seventh weld;
ii. a second vertically inclined bar holding metallic sleeving element of said second bar holder component for slideable receipt of said support bar, and welded at a first side thereof via said seventh weld to a second side of said second anchoring plate;
jj. a hole in said second vertically inclined bar holding sleeving element;
kk. an eighth weld;
ll. a fourth internally threaded nut welded via said eighth weld to a second side of said second vertically inclined bar holding sleeving element about said hole in said second vertically inclined bar holding sleeving element;
mm. a fourth externally threaded bolt receivable by said fourth nut and further receivable by said hole in said second vertically inclined bar holding sleeving element;
nn. a fourth metallic turning handle unit;
oo. a centrally positioned closed hole in said fourth turning handle unit for press fitted receipt of a head portion of said fourth externally threaded bolt;
pp. a third horizontally inclined bar holding sleeving element for slideable receipt of said first crossbar, and being a part of said first adjustable workholder component;
qq. a hole in said third horizonally inclined bar holding sleeving element;
rr. a ninth weld;
ss. a fifth internally threaded nut welded via said ninth weld to a first side of said third horizontally inclined bar holding sleeving element about said hole;
tt. a fifth externally threaded bolt receivable by said fifth internally threaded nut;
uu. a fifth metallic turning handle unit;
vv. a centrally positioned closed hole in said fifth turning handle unit for press fitted receipt of a head of said fifth externally threaded bolt;
ww. a first elongated internally threaded bolt holder unit;
xx. a tenth weld for welding said first elongated internally threaded bolt holder unit to a second side of said third horizontally inclined bar holding sleeving element;
yy. a first elongated, vertically inclined holding bolt with metallic first base rod extension member portion thereof and with said first holding bolt being receivable by said first elongated internally threaded bolt holder unit;
zz. a first metallic turning cap unit;
aaa. a closed hole in said first turning cap unit for press fitted receipt of a head portion of said first elongated, vertically inclined holding bolt;
bbb. a first superior horizontally inclined through hole in said first turning cap unit;
ccc. a first metallic turning rod slideably insertable within said first superior through hole;
ddd. a metallic ball shaped end portion of said first base rod extension member portion;
eee. a first solid metallic shoeholder element;
fff. a first end portion hollow, metallic housing unit for loosely and rotatably holding said ball shaped end portion and being soldered at a base brim portion thereof to a topside of said first shoeholder element;
ggg. a first superiorly positioned hole in said first housing unit and ultimately having a greatest crosswise breadth being less than a diameter of said ball shaped end portion of said first base rod extension member;
hhh. a fourth horizontally inclined bar holding metallic sleeving element for slideable receipt of said second crossbar, and being a part of said second adjustable workholder component;
iii. a round hole in said fourth horizontally inclined bar holding sleeving element;
jjj. an eleventh weld;
kkk. a sixth internally threaded nut welded via said eleventh weld to a first side of said fourth horizontally inclined bar holding sleeving element about said round hole;
lll. a sixth externally threaded bolt receivable by said sixth internally threaded nut;
mmm. a sixth metallic turning handle unit;
nnn. a centrally positioned closed hole in said sixth turning handle unit for press fitted receipt of a head portion of said sixth externally threaded bolt;
ooo. a second elongated internally threaded bolt holder unit;
ppp. a twelfth weld for welding said second elongated internally threaded bolt holder unit to a second side of said fourth horizontally inclined bar holding sleeving element;
qqq. a second elongated, vertically inclined holding bolt with metallic base rod extension member portion thereof and with said second holding bolt being receivable by said second elongated internally threaded bolt holder unit;
rrr. a second metallic turning cap unit;

sss. a closed hole in said second turning cap unit for press fitted receipt of a head portion of said second elongated, vertically inclined holding bolt;

ttt. a second superior horizontally inclined through hole in said second turning cap unit;

uuu. a second metallic turning rod slideably insertable within said second superior through hole;

vvv. a metallic ball shaped end portion of said second base rod extension member portion;

www. a second solid metallic shoeholder element;

xxx. a second end portion hollow, metallic housing unit for loosely and rotatably holding said ball shaped end portion of said second base rod extension member and being soldered with a solder material at a base brim portion thereof to a topside of said second shoeholder element;

yyy. a superiorly positioned hole in said second housing unit and ultimately having a greatest crosswise breadth being less than a diameter of said ball shaped end portion of said second base rod extension member;

zzz. a first sandbag shoe element;

aaaa. said first sandbag shoe element being a tripartite shoe element;

bbbb. a sleeving member portion of said first sandbag shoe element for slideable receipt of said first shoeholder element;

cccc. a medially positioned flat base member of said first sandbag shoe element;

dddd. a first centrally positioned through hole in said sleeving member;

eeee. a second centrally positioned through hole in said flat base member;

ffff. a round peg unit press fittable into each of said first through hole and said second through hole;

gggg. a sandbag member of said first sandbag shoe element;

hhhh. upper edging of said sandbag member;

iiii. glue adhesive material for gluing said upper edging of said sandbag member to a topside of said flat base member and a flat bottomside of said sleeving member portion;

jjjj. a solid shoe element;

kkkk. a sleeving member portion of said solid shoe element for slideable receipt of said second shoeholder element, and;

llll. a variably shaped base member portion of said solid shoe element.

17. The multipurpose woodworker's clamping and spreading apparatus of claim 16, whereby, said base member portion of said second shoe element is convexly rounded in shape.

18. The multipurpose woodworker's clamping and spreading apparatus of claim 16, whereby, said base member portion of said second shoe element is concavely rounded in shape.

19. The multipurpose woodworker's clamping and spreading apparatus of claim 16, whereby, said base member portion of said second shoe element is convexly triangular in shape.

20. The multipurpose woodworker's clamping and spreading apparatus of claim 16, whereby, said base member portion of said second shoe element is concavely triangular in shape with anterior and posterior edging.

21. The multipurpose woodworker's clamping and spreading apparatus of claim 16, whereby, said base member portion of said second shoe element is flat sided in shape.

22. The multipurpose woodworker's clamping and spreading apparatus of claim 16, whereby, said base member portion of said second shoe element is right triangular in shape.

23. The multipurpose woodworker's clamping and spreading apparatus of claim 16, whereby, said base member portion of said second shoe element is wavy irregular in shape.

24. A multipurpose woodworker's clamping and spreading apparatus, comprising:

a. a vertically inclined metallic support bar;

b. a first horizontally inclined metallic crossbar;

c. a second horizontally inclined metallic crossbar;

d. a first two-way adjustable bar holder component;

e. a second two-way adjustable bar holder component;

f. a first adjustable workholder component;

g. a second adjustable workholder component;

h. a first horizontally inclined bar holding metallic sleeving element of said first bar holder component for slideable receipt of said first horizontally inclined crossbar;

i. a hole in said first horizontally inclined bar holding sleeving element;

j. a first weld;

k. a first internally threaded nut welded via said first weld to a first side of said first horizontally inclined bar holding sleeving element about said hole in said first horizontally inclined bar holding sleeving element;

l. a first externally threaded bolt receivable by said first internally threaded nut and further receivable by said hole in said first horizontally inclined bar holding sleeving element;

m. a first metallic turning handle unit;

n. a centrally positioned closed hole in said first handle unit for press fitted receipt of a head portion of said first externally threaded bolt;

o. a first metallic anchoring plate;

p. a second weld for welding a second side of said first horizontally inclined bar holding sleeving element to a first side of said first anchoring plate;

q. a third weld;

r. a first vertically inclined bar holding metallic sleeving element of said first bar holder component for slideable receipt of said support bar, and welded at a first side thereof by said third weld to a second side of said first anchoring plate;

s. a hole in said first vertically inclined bar holding sleeving element;

t. a fourth weld;

u. a second internally threaded nut welded via said fourth weld to a second side of said first vertically inclined bar holding sleeving element, and about said hole in said first vertically inclined bar holding sleeving element;

v. a second externally threaded bolt receivable by said second internally threaded nut and said hole in said first vertically inclined bar holding sleeving element;

w. a second metallic turning handle unit;

x. a centrally positioned closed hole in said second turning handle unit for press fitted receipt of a head portion of said second externally threaded bolt;

y. a second horizontally inclined bar holding metallic sleeving element of said second bar holder component for slideable receipt of said second horizontally inclined crossbar;

z. a hole in said second horizontally inclined bar holding sleeving element;

aa. a fifth weld;

bb. a third internally threaded nut welded via said fifth weld to a first side of said second horizontally inclined bar holding sleeving element about said hole in said second horizontally inclined bar holding sleeving element;

cc. a third externally threaded bolt receivable by said third internally threaded nut further receivable by said hole in said second horizontally inclined bar holding sleeving element;

dd. a third metallic turning handle unit;

ee. a centrally positioned closed hole in said third handle unit for press fitted receipt of a head portion of said third externally threaded bolt;

ff. a second metallic anchoring plate;

gg. a sixth weld for welding a second side of said second horizontally inclined bar holding sleeving element to a first side of said second anchoring plate;

hh. a seventh weld;

ii. a second vertically inclined bar holding metallic sleeving element of said second bar holder component for slideable receipt of said support bar, and welded at a first side thereof via said seventh weld to a second side of said second anchoring plate;

jj. a hole in said second vertically inclined bar holding sleeving element;

kk. an eighth weld;

ll. a fourth internally threaded nut welded via said eighth weld to a second side of said second vertically inclined bar holding sleeving element about said hole in said second vertically inclined bar holding sleeving element;

mm. a fourth externally threaded bolt receivable by said fourth nut and further receivable by said hole in said second vertically inclined bar holding sleeving element;

nn. a fourth metallic turning handle unit;

oo. a centrally positioned closed hole in said fourth turning handle unit for press fitted receipt of a head portion of said fourth externally threaded bolt;

pp. a third horizontally inclined bar holding sleeving element for slideable receipt of said first crossbar, and being a part of said first adjustable workholder component;

qq. a hole in said third horizonally inclined bar holding sleeving element;

rr. a ninth weld;

ss. a fifth internally threaded nut welded via said ninth weld to a first side of said third horizontally inclined bar holding sleeving element about said hole;

tt. a fifth externally threaded bolt receivable by said fifth internally threaded nut;

uu. a fifth metallic turning handle unit;

vv. a centrally positioned closed hole in said fifth turning handle unit for press fitted receipt of a head of said fifth externally threaded bolt;

ww. a first elongated internally threaded bolt holder unit;

xx. a tenth weld for welding said first elongated internally threaded bolt holder unit to a second side of said third horizontally inclined bar holding sleeving element;

yy. a first elongated, vertically inclined holding bolt with metallic first base rod extension member portion thereof and with said first holding bolt being receivable by said first elongated internally threaded bolt holder unit;

zz. a first metallic turning cap unit;

aaa. a closed hole in said first turning cap unit for press fitted receipt of a head portion of said first elongated, vertically inclined holding bolt;

bbb. a first superior horizontally inclined through hole in said first turning cap unit;

ccc. a first turning rod slideably insertable within said first superior through hole;

ddd. a metallic ball shaped end portion of said first base rod extension member portion;

eee. a first solid metallic shoeholder element;

fff. a first end portion hollow, metallic housing unit for loosely and rotatably holding said ball shaped end portion and being soldered at a base brim portion thereof to a topside of said first shoeholder element;

ggg. a first superiorly positioned hole in said first housing unit and ultimately having a greatest crosswise breadth being less than a diameter of said ball shaped end portion of said first base rod extension member;

hhh. a fourth horizontally inclined bar holding metallic sleeving element for slideable receipt of said second crossbar, and being a part of said second adjustable workholder component;

iii. a round hole in said fourth horizontally inclined bar holding sleeving element;

jjj. an eleventh weld;

kkk. a sixth internally threaded nut welded via said eleventh weld to a first side of said fourth horizontally inclined bar holding sleeving element about said round hole;

lll. a sixth externally threaded bolt receivable by said sixth internally threaded nut;

mmm. a sixth metallic turning handle unit;

nnn. a centrally positioned closed hole in said sixth turning handle unit for press fitted receipt of a head portion of said sixth externally threaded bolt;

ooo. a second elongated internally threaded bolt holder unit;

ppp. a twelfth weld for welding said second elongated internally threaded bolt holder unit to a second side of said fourth horizontally inclined bar holding sleeving element;

qqq. a second elongated, vertically inclined holding bolt with metallic base rod extension member portion thereof and with said second holding bolt being receivable by said second elongated internally threaded bolt holder unit;

ttt. a second metallic turning cap unit;

sss. a closed hole in said second turning cap unit for press fitted receipt of a head portion of said second elongated, vertically inclined holding bolt;

ttt. a second superior horizontally inclined through hole in said second turning cap unit;

uuu. a second metallic turning rod slideably insertable within said second superior through hole;

vvv. a metallic ball shaped end portion of said second base rod extension member portion;

www. a second solid metallic shoeholder element;

xxx. a second end portion hollow, metallic housing unit for loosely and rotatably holding said ball shaped end portion of said second base rod extension member, and being soldered with a solder material at a base brim portion thereof to a topside of said second shoeholder element;

yyy. a superiorly positioned hole in said second housing unit and ultimately having a greatest crosswise breadth being less than a diameter of said ball shaped end portion of said second base rod extension member;

zzz. a first sandbag shoe element;

aaaa. said first sandbag shoe element being a tripartite shoe element;

bbbb. a sleeving member portion of said first sandbag shoe element for slideable receipt of said first shoe-holder element;

cccc. a medially positioned flat base member of said first sandbag shoe element;

dddd. a first centrally positioned through hole in said sleeving member;

eeee. a second centrally positioned through hole in said flat base member;

ffff. a round peg unit press fittable into each of said first through hole and said second through hole;

gggg. a sandbag member of said first sandbag shoe element;

hhhh. upper edging of said sandbag member;

iiii. glue adhesive material for gluing said upper edging of said sandbag member to a topside of said flat base member and to a flat bottomside of said sleeving member portion;

jjjj. a second sandbag shoe element;

kkkk. said second sandbag shoe element being a tripartite shoe element;

llll. a second sleeving member portion of said second sandbag shoe element for slideable receipt of said second shoeholder component;

mmmm. a medially positioned second flat base member of said second sandbag shoe element;

nnnn. a centrally positioned through hole in said second sleeving member;

oooo. another centrally positioned through hole in said second flat base member;

pppp. a second round peg unit press fittable into said through hole and said another through hole;

qqqq. a second sandbag member of said second sandbag shoe element;

rrrr. upper edging of said second sandbag member of said second shoe element, and;

ssss. glue adhesive material for gluing said upper edging of said second sandbag member to a topside of said second flat base member and to a flat bottomside of said second sleeving member portion.

* * * * *